US006955144B2

(12) United States Patent
Sakai et al.

(10) Patent No.: US 6,955,144 B2
(45) Date of Patent: Oct. 18, 2005

(54) VALVE CONTROL APPARATUS FOR INTERNAL COMBUSTION ENGINE

(75) Inventors: Hisao Sakai, Wako (JP); Yasuo Shimizu, Wako (JP); Toshihiro Yamaki, Wako (JP); Hidetaka Ozawa, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/484,990

(22) PCT Filed: Jul. 26, 2002

(86) PCT No.: PCT/JP02/07624

§ 371 (c)(1),
(2), (4) Date: Jan. 26, 2004

(87) PCT Pub. No.: WO03/010420

PCT Pub. Date: Feb. 6, 2003

(65) Prior Publication Data

US 2004/0168658 A1 Sep. 2, 2004

(30) Foreign Application Priority Data

Jul. 26, 2001 (JP) ..... 2001-226709
Jul. 19, 2002 (JP) ..... 2002-211325

(51) Int. Cl.[7] ..... F01L 9/04

(52) U.S. Cl. ..... 123/90.11; 123/90.16; 123/90.15; 123/90.39

(58) Field of Search ..... 123/90.11, 90.16, 123/90.39, 90.36, 90.15

(56) References Cited

U.S. PATENT DOCUMENTS 4,159,753 A * 7/1979 Boche ..... 180/170
4,408,580 A * 10/1983 Kosuda et al. ..... 123/90.16
6,016,779 A * 1/2000 Nemoto et al. ..... 123/90.16

FOREIGN PATENT DOCUMENTS

| | | |
|---|---|---|
| JP | 54-83940 | 1/1981 |
| JP | 56-50209 A | 5/1981 |
| JP | 62-41907 | 2/1987 |
| JP | 9-96206 A | 4/1997 |
| JP | 11-193708 | 7/1999 |

* cited by examiner

*Primary Examiner*—Thomas Denion
*Assistant Examiner*—Zelalem Eshete
(74) *Attorney, Agent, or Firm*—Lahive & Cockfield, LLP; Anthony A. Laurentano, Esq

(57) ABSTRACT

A valve control apparatus for an internal combustion engine is provided which is capable of optimally setting the closing timing of an engine valve according to operating conditions of the engine while suppressing an increase in the inertial mass of the engine valve to the minimum, thereby attaining improvement of fuel economy, and realization of higher engine rotational speed and higher power output in a compatible fashion, and reducing costs and weight thereof. The valve control apparatus controls opening and closing operations of an engine valve. A cam-type valve actuating mechanism actuates the engine valve to open and close the engine valve, by a cam which is driven in synchronism with rotation of the engine. An actuator makes blocking engagement with the engine valve having been opened, to thereby hold the engine valve in an open state. An ECU controls operation of the actuator to thereby control closing timing of the engine valve.

14 Claims, 18 Drawing Sheets

| OPERATING REGION | IV1 | IV2 | EMA |
|---|---|---|---|
| A | Lo. V/T | INACTIVE V/T | INACTIVE |
| B | Lo. V/T | INACTIVE V/T | ACTIVE |
| C | Lo. V/T | INACTIVE V/T | INACTIVE |
| D1 | Lo. V/T | Lo. V/T | ACTIVE |
| D2 | Lo. V/T | Lo. V/T | INACTIVE |
| D3 | Hi. V/T | Hi. V/T | INACTIVE |

| OPERATING REGION | IV1 | IV2 | ELECTROMAGNETIC VALVE |
|---|---|---|---|
| G | Lo. V/T | INACTIVE V/T | INACTIVE |
| H | Lo. V/T | INACTIVE V/T | EARLY OPENING& LATE CLOSING |
| I | Lo. V/T | INACTIVE V/T | EARLY OPENING |
| J | Hi. V/T | Hi. V/T | INACTIVE |

VALVE CONTROL APPARATUS FOR INTERNAL COMBUSTION ENGINE

RELATED APPLICATIONS

This application is a 35 U.S.C. 371 national stage filing of International Application No. PCT/JP02/07624, filed 26 Jul. 2002, which claims priority to Japan Patent Application No. 2001-226709 filed on 26 Jul. 2001, in Japan and Japan Patent Application No. 2002-211325 filed on 19 Jul. 2002, in Japan. The contents of the aforementioned applications are hereby incorporated by reference.

TECHNICAL FIELD

This invention relates to a valve control apparatus for controlling opening and closing operations of intake valves and/or exhaust valves, more particularly for controlling valve-closing timing thereof.

BACKGROUND ART

Conventionally, with a view to improving fuel economy and power output of an internal combustion engine and reducing exhaust emissions therefrom, various kinds of valve control apparatuses have been proposed which variably control the opening and closing timing or the valve lift of intake valves and/or exhaust valves so as to attain intake and exhaust performance suitable for operating conditions of the engine. As one of such conventional valve control apparatuses, a type is known which changes the phase of an intake cam with respect to a camshaft to thereby continuously change the opening and closing timing of an intake cam (e.g. Japanese Laid-Open Patent Publication (Kokai) No. 7-301144). In this type of valve control apparatus, however, the intake valve opens over a fixed valve-opening time period, so that when the opening timing of the intake valve is determined, the closing timing thereof is automatically determined. This makes it impossible to attain the optimum valve-opening timing and the optimum valve-closing timing at the same time for all regions of the rotational speed of the engine and load on the same which change steplessly.

Further, as another type of conventional valve control apparatus (e.g. Japanese Laid-Open Patent Publication (Kokai) No. 62-12811) is known in which each of an intake cam and an exhaust cam is formed by a high-speed cam and a low-speed cam having respective predetermined cam profiles different from each other, and each cam is switched between the low-speed cam and the high-speed cam for use in low rotational speed and high rotational speed of the engine, respectively. In this type of valve control apparatus, however, the cam profile is changed between two stages, and hence the opening and closing timing and valve lift of the intake/exhaust valve are also merely changed between two stages. Therefore, this apparatus is also not capable of attaining the optimum valve-opening/closing timing and valve lift for all regions of the rotational speed and load.

Further, still another type of a valve control apparatus (e.g. Japanese Laid-Open Patent Publication (Kokai) No. 8-200025) is known which uses electromagnets to open and close intake valves and exhaust valves. In this valve control apparatus, two intake valves and two exhaust valves are provided for each cylinder, and these four intake and exhaust valves are actuated by respective electromagnetic valve actuating mechanisms (hereinafter, this valve control apparatus is referred to as "the fully-electromagnetic valve control apparatus"). Each electromagnetic valve actuating mechanism is comprised of a pair of electromagnets opposed to each other, an armature arranged between the electromagnets and connected to the intake/exhaust valve associated therewith, and two coil springs urging the armature. In this electromagnetic valve actuating mechanism, the energization of the two electromagnets is controlled to cause the armature to be attracted to one of the electromagnets in an alternating fashion to thereby open and close the intake/exhaust valve. Therefore, by controlling the timing of energization, the opening and closing timing of the intake/exhaust valve can be controlled as desired, whereby it is possible to realize the optimum opening and closing timing for all regions of the rotational speed and load and optimize fuel economy, power output, etc. It should be noted that when the two electromagnets are not energized, the armature is held in a neutral position by the balance of the urging forces of the two coil springs. In this fully-electromagnetic valve control apparatus, however, all the intake/exhaust valves are each actuated by the electromagnetic valve actuating mechanism, so that the electric power consumption becomes very large, which reduces the effects of the improved fuel economy. Further, the electromagnets and armature of the electromagnetic valve actuating mechanism are formed by magnetic substances, which results in an increase in weight and manufacturing cost of the apparatus.

As a solution to this problem, the present applicant has already proposed by Japanese Patent Application No. 20001-012300 a valve control apparatus (hereinafter referred to as "the first valve control apparatus") which actuates only one of two intake valves provided for one cylinder by an electromagnetic valve actuating mechanism similar to that described above, and the other of the intake valves and exhaust valves by cam-type valve actuating mechanisms operating in synchronism with rotation of the engine. In this first valve control apparatus, the opening timing and the closing timing of the one of the intake valves are set as desired according to operating conditions of the engine by using the electromagnetic valve actuating mechanism, whereby the optimum opening and closing timing can be realized, and the improvement of the fuel economy and the enhancement of the power output are made compatible. Further, compared with the fully-electromagnetic valve control apparatus, the number of electromagnetic valve actuating mechanisms is reduced to one fourth, which contributes to the fuel economy through reduction of electric power consumption, and reduction of weight and manufacturing costs.

Another valve control apparatus proposed by the present applicant is also known which is disclosed in Japanese Laid-Open Patent Publication (Kokai) No. 63-289208 (hereinafter referred to as "the second valve control apparatus"). The second valve control apparatus includes a cam-type valve actuating mechanism for opening and closing an intake valve via a rocker arm by using a cam provided on a camshaft, and an electromagnetic actuator for holding the intake valve in an open position. This electromagnetic actuator is comprised of one solenoid fixed to a cylinder head, an armature fixed to a valve stem of the intake valve, and an impact-absorbing spring arranged between the armature and a retainer, and according to operating conditions of the engine, energizes the solenoid when the intake valve has reached the open position to cause the attractive force to act on the armature, whereby the intake valve is held in the open position to control the closing timing of the intake valve.

However, although the first valve control apparatus alleviates the problem suffered by the fully-electromagnetic valve control apparatus, due to its use of the electromagnetic valve actuating mechanism for part thereof, there still remains room for improvement in the following points: This valve control apparatus necessitates one electromagnetic valve actuating mechanism for one cylinder, and hence two electromagnets for one cylinder. This results in increased electric power consumption, and decreases the advantageous effects of improvement of fuel economy thanks to the variable opening and closing timing of the intake valve, and compared with the ordinary cam-actuated type valve control apparatus, the weight and manufacturing costs are still large. Further, the maximum rotational speed of the engine available through the use of the electromagnetic valve actuating mechanisms is substantially determined by a spring constant of each coil spring. This makes it necessary to set the spring constant of the coil spring to a large value and accordingly electromagnets providing large attractive forces are also required to be employed, when the apparatus is applied to an internal combustion engine whose maximum rotational speed is high (e.g. about 9000 rpm). This results in an increased electric power consumption, and degrades fuel economy in low-to-medium rotational speed operating regions in which the engine is usually operated more frequently than in other regions, and makes it difficult to attain the improvement of fuel economy and the realization of higher rotational speed and higher power output in a compatible fashion.

Further, the second valve control apparatus is only required to arrange one electromagnet for one intake valve of each cylinder, and therefore has advantages over the first valve control apparatus in that it can further reduce the electric power consumption and improve the fuel economy. However, there remains room for improvement in the following points: In the second valve control apparatus, irrespective of whether the electromagnetic actuator is active or inactive, the weight of the armature and the spring force of the impact-absorbing spring always act on the intake valve. This increases the inertial mass of the intake valve in the inactive state of the electromagnetic actuator, which restricts the maximum engine rotational speed and the maximum power output. In this case, to increase the maximum engine rotational speed, it is necessary to increase the spring constant of the valve spring. This degrades fuel economy due to an increase in electric power consumption, and makes it impossible to attain the improvement of fuel economy and the realization of higher engine rotational speed and higher power output in a compatible fashion, or sufficiently reduce the weight and manufacturing costs. Further, in the case of this valve control apparatus, to mount the solenoid, the armature, the impact-absorbing spring therein, it is necessary to modify the designs of the cylinder head and intake valves, at inevitably very high expenses.

This invention has been made with a view to providing a solution to these problems, and an object thereof is to provide a valve control apparatus for an internal combustion engine that is capable of optimally setting the closing timing of an engine valve according to operating conditions of the engine while suppressing an increase in the inertial mass of the engine valve to the minimum, thereby attaining improvement of fuel economy, and realization of higher engine rotational speed and higher power output in a compatible fashion, and reducing costs and weight thereof.

DISCLOSURE OF INVENTION

To attain the above object, the invention provides a valve control apparatus for an internal combustion engine for controlling opening and closing operations of an engine valve, the valve control apparatus comprising a cam-type valve actuating mechanism that actuates the engine valve to open and close the engine valve, by a cam which is driven in synchronism with rotation of the engine, an actuator that makes blocking engagement with the engine valve having been opened, to thereby hold the engine valve in an open state, and control means for controlling operation of the actuator to thereby control closing timing of the engine valve.

According to this valve control apparatus for an internal combustion engine, the engine valve is opened and closed by a cam driven in synchronism with rotation of the cam-type valve actuating mechanism. Further, under the control of the control means, the actuator makes blocking engagement with the engine valve having been opened so as to hold the same in the open state, and further, by canceling the holding, the closing timing of the engine valve is controlled.

As described above, according to this invention, while actuating the engine valve by the cam-type actuating mechanism, the actuator is operated as required, whereby the closing timing of the engine valve can be controlled as desired. This makes it possible to attain the optimum fuel economy and power output adapted to operating conditions of the engine. For instance, when the engine valve is an intake valve, in a low-rotational speed/low-load condition, the closing timing of the intake valve is controlled to late closing according to the operating conditions of the engine, thereby reducing the pumping loss of the intake valve to the minimum, whereby the fuel economy can be enhanced. On the other hand, in the high-rotational speed/high-load region, the actuator is made inactive, and only the cam-type valve actuating mechanism actuates the intake cam, whereby the higher rotational speed and higher power output can be attained without being affected by the follow-up capability of the actuator. Further, when the engine valve is an exhaust valve, by varying the closing timing of the exhaust valve, the overlap amount is controlled, whereby the power output can be improved and the exhaust emissions can be reduced.

Further, the engine valve is basically actuated by the cam-type actuating mechanism, and the actuator is only required to make blocking engagement with the engine valve in one direction, which allows the apparatus to be simplified in construction. Further, since the actuator can be operated only when necessary, the energy saving can be attained, and the fuel economy can be further enhanced by this feature. Further, since the engine valve can be actuated by the cam-type actuating mechanism alone, even when a fail occurred on the actuator, the fail can be easily coped with.

Preferably, the valve control apparatus as recited in claim 1 further comprises operating condition-detecting means for detecting operating conditions of the engine, and the control means controls the operation of the actuator according to the detected operating conditions of the engine.

According to this preferred embodiment, the operation of the actuator is controlled according to the detected operating conditions of the engine. This makes it possible to set the active or inactive state of the actuator and the closing timing of the engine valve optimally according to actual operating conditions of the engine, for all rotational speed regions and load regions.

More preferably, the valve control apparatus as recited in claim 2 further comprises a switching mechanism for switching an operation mode of the actuator between an active mode in which the actuator makes the blocking engagement with the engine valve and an inactive mode in which the valve actuator does not make the blocking engagement with the engine valve, and operation mode-determining means for determining the operation mode of the actuator according to the detected operating conditions of the engine, and the control means controls operation of the switching mechanism according to the determined operation mode.

According to this preferred embodiment, the actuator is switched between the active state and the inactive state, according to the operation mode determined according to the operating conditions of the engine, so that the actuator can be appropriately made active only when necessary according to the actual operating conditions of the engine. Further, when the operation mode of the actuator is set to the inactive mode, the switching mechanism places the actuator in a state not brought into blocking engagement with the engine valve, to thereby forcibly make the same inactive. Therefore, even when a fail occurred on the actuator itself, the engine valve can be actuated by the cam-type actuating mechanism without any trouble, while preventing the fail from adversely affecting the operation of the engine valve, which makes it possible to prevent degradation of combustion state and degradation of exhaust emissions.

Further preferably, in the valve control apparatus as recited in claim 2, the switching mechanism is formed by a hydraulic switching mechanism for hydraulically switching the operation mode of the actuator, and the control means causes the actuator to be made inactive when the engine is started.

According to this preferred embodiment, the switching mechanism is formed by the hydraulic switching mechanism, and the operation mode of the actuator is hydraulically switched between the active mode and the inactive mode. On the other hand, at the start of the engine, it takes time to increase oil pressure, and hence it is impossible to obtain sufficient oil pressure. Therefore, it is difficult for the hydraulic switching mechanism to operate stably, and hence there is a fear that the actuator cannot stably hold the engine valve. Therefore, the actuator is made inactive when the engine is started, and the engine is actuated only by the cam-type valve actuating mechanism, to ensure the stable operation of the engine valve.

Preferably, in the valve control apparatus as recited in any one of claims 1 to 4, the actuator is formed by an electromagnetic actuator comprising a single electromagnet that has a coil whose energization is controlled by the control means, an armature that is attracted to the electromagnet when the coil is energized, and a stopper provided integrally with the armature, for being brought into blocking engagement with the engine vale having been opened, in a state in which the armature has been attracted to the electromagnet.

According to the preferred embodiment, the actuator is formed by an electromagnetic actuator. Further, the electromagnetic actuator is configured to be brought into blocking engagement with the engine valve by driving the armature only in one direction by the single electromagnetic actuator. This makes one electromagnet sufficient for one engine valve, which makes it possible to reduce the weight and cost and minimize electric power consumption.

Preferably, the valve control apparatus as claimed in any one of claims 1 to 5, further comprises a hydraulic impact-lessening mechanism that lessens an impact on the engine valve caused by operation of the actuator.

According to this preferred embodiment, the hydraulic impact-lessening mechanism can lessen the impact received by the engine valve when the engine valve returns to its valve-closing position after cancellation of the holding thereof by the actuator, and suppress noise caused by the impact. Further, if the hydraulic impact-lessening mechanism is employed, in a very cold oil temperature condition at a very cold temperature start or a high oil temperature condition in a maximum rotational speed condition, the viscosity of hydraulic oil largely changes, which can make it impossible to preserve impact-lessening performance. Under such server temperature conditions, the actuator can be made inactive, whereby the impact-lessening performance can be fully ensured.

Further preferably, the valve control apparatus as recited in claim 3, further comprises a rocker shaft, an actuating rocker arm pivotally supported on the rocker shaft, for being brought into abutment with the engine valve and being driven by the intake cam to actuate the engine valve to open and close the engine valve, and a holding rocker arm pivotally supported on the rocker shaft, for having the actuator brought into abutment therewith, to hold the engine valve in the open state, and the switching mechanism switches the operation mode of the actuator between the active mode and the inactive mode, by switching a state of the actuating rocker arm and the holding rocker arm between a connected state in which the actuating rocker arm and the holding rocker arm are connected to each other, and a disconnected state in which the actuating rocker arm and the holding rocker arm are disconnected from each other.

According to this preferred embodiment, the engine valve is opened and closed by an actuating rocker arm driven by the intake cam. Further, the actuator is brought into abutment with a holding rocker arm as a separate member from the actuating rocker arm. Then, in the active mode of the actuator, the holding rocker arm and the actuating rocker arm are connected by the switching mechanism, whereby the engine is held in the open state by the actuator via the holding rocker arm and the actuating rocker arm. Further, in the inactive mode of the actuator, the actuating rocker arm and the holding rocker arm are disconnected from each other by the switching mechanism. Thus, when in the inactive mode, the actuating rocker arm is pivotally moved without being adversely affected by the holding rocker arm and the inertial mass of the actuator in a state completely free from them, which makes it possible to save energy, and improve the follow-up capability of the valve system at high rotational speed.

Still more preferably, in the valve control apparatus as claimed in claim 7, the actuating rocker arm comprises a plurality of actuating rocker arms, and the valve control apparatus further comprises a first hydraulic switching mechanism for hydraulically switching a state of the plurality of actuating rocker arms between a connected state in which the plurality of actuating rocker arms are connected to each other and a disconnected state in which the plurality of actuating rocker arms are disconnected from each other, the switching mechanism being formed by a second hydraulic switching mechanism, one of the plurality of actuating rocker arms being formed with an oil chamber for the first hydraulic switching mechanism, and the holding rocker arm being arranged adjacent to the actuating rocker arm formed with the oil chamber.

According to this preferred embodiment, the holding rocker arm is disposed in the vicinity of the actuating rocker arm having the oil chamber formed therein for the first hydraulic switching mechanism. Therefore, the oil passages for the first and second hydraulic switching mechanisms can be arranged close to each other, whereby machining and forming of the oil passages can be facilitated, and oil pressure loss can be reduced.

Still more preferably, in the valve control apparatus as claimed in claim 7 or 8, an abutment portion of the holding rocker arm with which the actuator abuts is disposed at a location remoter from the rocker shaft than an abutment portion of the actuating rocker arm with which the engine valve abuts is.

According to this preferred embodiment, the abutment portion of the holding rocker arm with which the actuator abuts is disposed at a location remoter from the rocker shaft as a support of the two rocker arms than the abutment portion of the actuating rocker arm with which the engine valve abuts is. Therefore, the holding force of the actuator required for holding the engine valve can be reduced, whereby the size of the actuator can be reduced and energy saving can be attained. Further, since the holding rocker arm and the actuating rocker arm are separate from each other, even if the abutment portion with which the actuator abuts is disposed as above, it is possible to avoid the increase in the size of the actuating rocker arm, the resulting increase in the inertial mass in the inactive mode.

Still more preferably, in the valve control apparatus as recited in claim 7 or 8, an abutment portion of the holding rocker arm with which the actuator abuts is disposed at a location closer to the rocker shaft than an abutment portion of the actuating rocker arm with which the engine valve abuts is.

According to this preferred embodiment, the abutment portion of the holding rocker arm with which the actuator abuts is disposed at a location closer to the rocker shaft than the abutment portion of the actuating rocker arm with which the engine valve abuts is. Therefore, the stroke of the actuator required for holding the engine valve can be reduced. Further, since the holding rocker arm is a separate member from the actuating rocker arm, even if the abutment portion with which the actuator abuts is disposed as described above, interference with a member arranged in its vicinity, e.g. the first hydraulic switching mechanism can be avoided, and hence the actuator can be disposed in compact arrangement in the operating direction thereof.

Also, still more preferably, in the valve control apparatus as recited in any of claims 7 to 10, the switching mechanism switches a state of the actuating rocker arm and the holding rocker arm to a connected state when the engine is in a low rotational speed condition, and to a disconnected state when the engine is in a high rotational speed condition.

According to this preferred embodiment, the holding rocker arm is connected to the actuating rocker arm at the low rotational speed of the engine, whereas during high rotational speed of the same, the holding rocker arm is disconnected from the actuating rocker arm. This makes it possible to avoid the increase in the inertial mass of the actuating rocker arm particularly during high rotational speed of the engine, whereby the follow-up capability of the valve system can be enhanced.

The above and other objects, features, and advantages of the invention will become more apparent from the following detailed description taken in conjunction with the accompanying drawings.

BEST MODE FOR CARRYING OUT THE INVENTION

Figure 1:
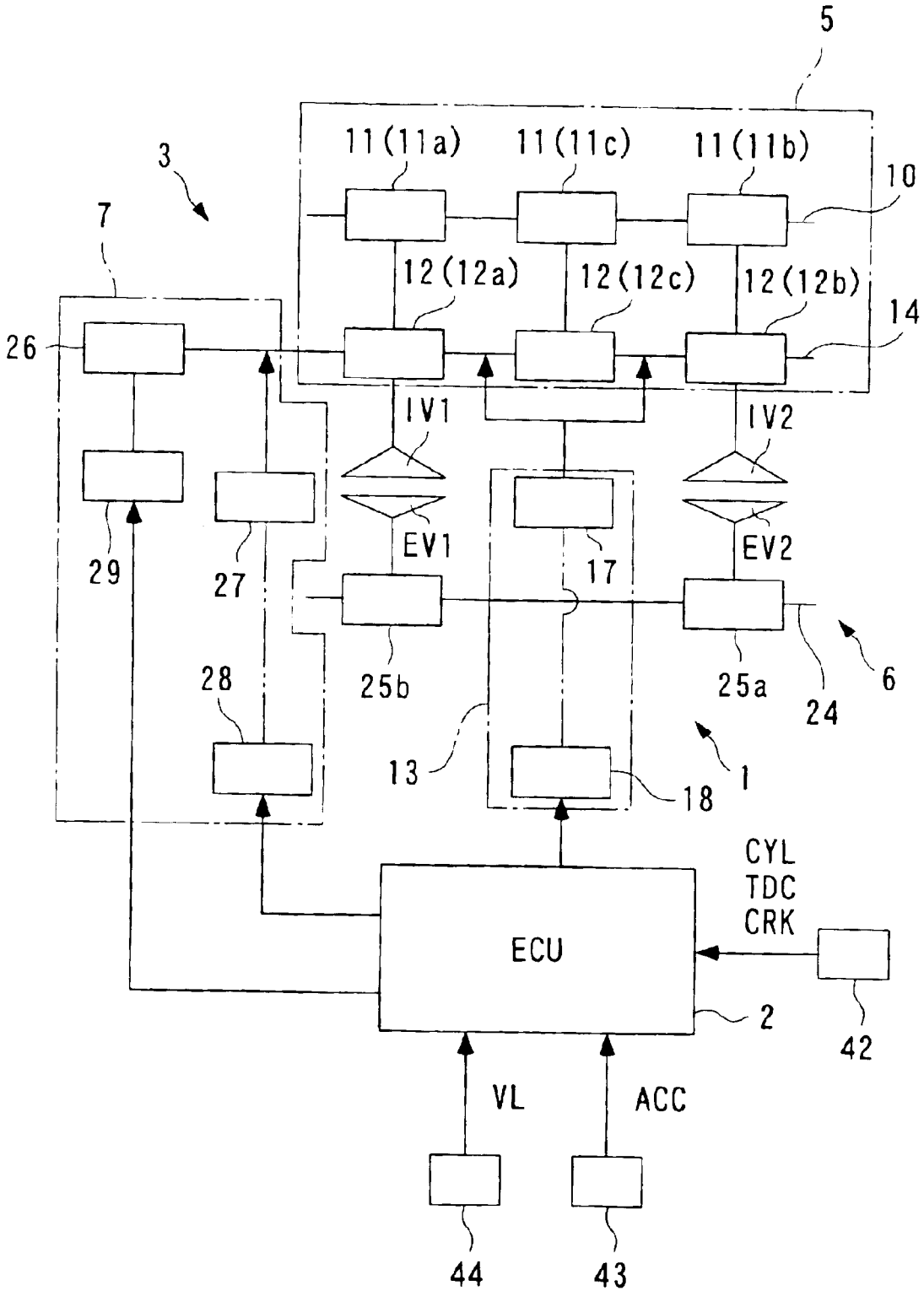
FIG. 1 is a block diagram schematically showing the arrangement of a valve control apparatus for an internal combustion engine, according to a first embodiment of the invention.
Figure 2:
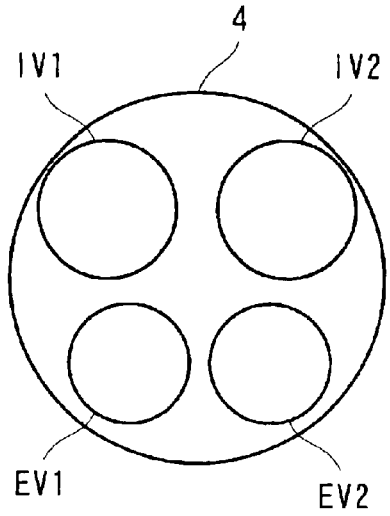
FIG. 2 is a diagram showing the arrangement of intake valves and exhaust valves.
Figure 3:
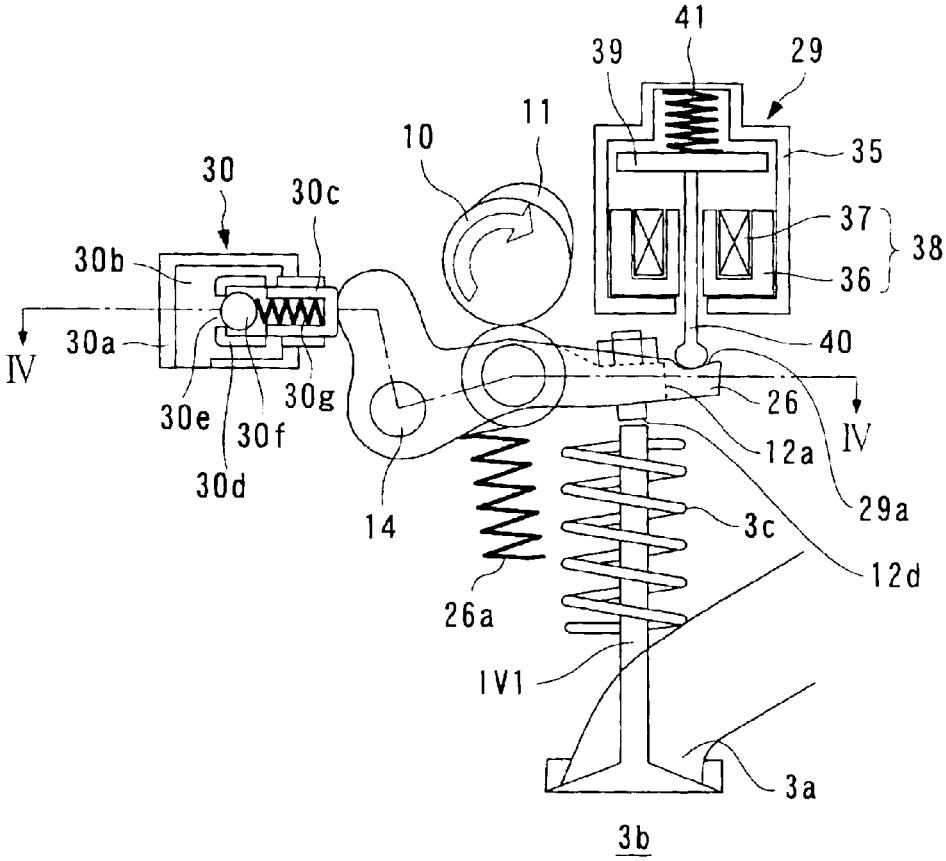
FIG. 3 is a side view of an intake valve and a valve control apparatus.

Hereafter, a valve control apparatus for an internal combustion engine, according an embodiment of the invention, will be described with reference to drawings. FIG. 1 schematically shows the arrangement of the valve control apparatus to which the present invention is applied. An internal combustion engine (hereinafter referred to as "the engine") 3 shown therein is a four-cylinder (only one cylinder is shown in FIG. 2) in-line DOHC gasoline engine installed on a vehicle not shown. As shown in FIG. 2, each cylinder 4 is provided with first and second intake valves IV1, IV2, and first and second exhaust valves EV1, EV2, as engine valves. As illustrated in FIG. 3 showing an example of the first intake valve IV1, the intake valves IV1, IV2 are arranged such that each of them is movable between a closed position (shown in FIG. 3) for closing an intake port 3*a* of the engine 3 and an open position (not shown) projected into a combustion changer 3*b*, for opening the intake port 3*a*, while being urged by a coil spring 3*c* toward the closed position.

As shown in FIG. 1, the valve control apparatus 1 comprises a cam-type valve actuating mechanism 5 provided on an intake side for opening and closing the two intake valves IV1, IV2, and a cam-type valve actuating mechanism 6 provided on an exhaust side for opening and closing the two exhaust valves EV1, EV2, a variable valve-closing timing device 7 for varying the closing timing of the first intake valve IV1, a cam profile-switching mechanism 13 for switching between cam profiles of an intake cam 11, referred to hereinafter, of the cam-type valve actuating mechanism 6, and an ECU 2 (control means) for controlling operations of these devices.

The cam-type valve actuating mechanism 5 on the intake side is comprised of a camshaft 10, the intake cam integrally formed on the camshaft 10, and a rocker arm 12 which is driven by the intake cam and pivotally movable for converting the rotating motion of the camshaft 10 into reciprocating motions of the intake valves IV1, IV2. The camshaft 10 is connected to a crankshaft, not shown, of the engine 3 via a driven sprocket and a timing chain (none of which is shown), and driven by the crankshaft, for rotation such that it performs one rotation per two rotations of the crankshaft.

As shown in FIG. 1, the intake cam 11 is comprised of a low-speed cam 11*a*, an inactive cam 11*b* having a very low cam nose, and a high-speed cam 11*c* disposed between the two cams 11*a*, 11*b* and having a higher cam profile than that of the low-speed cam 11*a*. The rocker arm 12 is comprised of a low-speed rocker arm 12*a*, an inactive rocker arm 12*b*, and a high-speed rocker arm 12*c*, as actuating rocker arms. These low-speed, inactive, and high-speed rocker arms 12*a* to 12*c* are pivotally mounted on a rocker shaft 14, and arranged in a manner associated with the low-speed, inactive, and high-speed cams 11*a* to 11*c* of the intake cam 11, respectively, such that these cams 11*a* to 11*c* are in slidable contact therewith via respective rollers 15*a* to 15*c*. The low-speed rocker arm 12*a* and the inactive rocker arm 12*b* are in abutment with the upper ends of the first intake valve IV1 and the second intake valve IV2, respectively. Further, the rocker shaft 14 is formed with two lines of oil passages: a first oil passage 16*a* for a cam profile-switching mechanism 13, and a second oil passage 16*b* for the variable valve-closing timing device 7 (see FIG. 4).

The cam profile-switching mechanism (hereinafter referred to as "the VTEC") 13 is comprised of a first switching valve 17 for hydraulically switching between connection and disconnection of the low-speed and inactive rocker arms 12*a*, 12*b* and the high-speed rocker arm 12*c*, and a first oil pressure-switching mechanism 18 for switching between the supply and cut-off of the oil pressure to the first switching valve 17.

Figure 4:
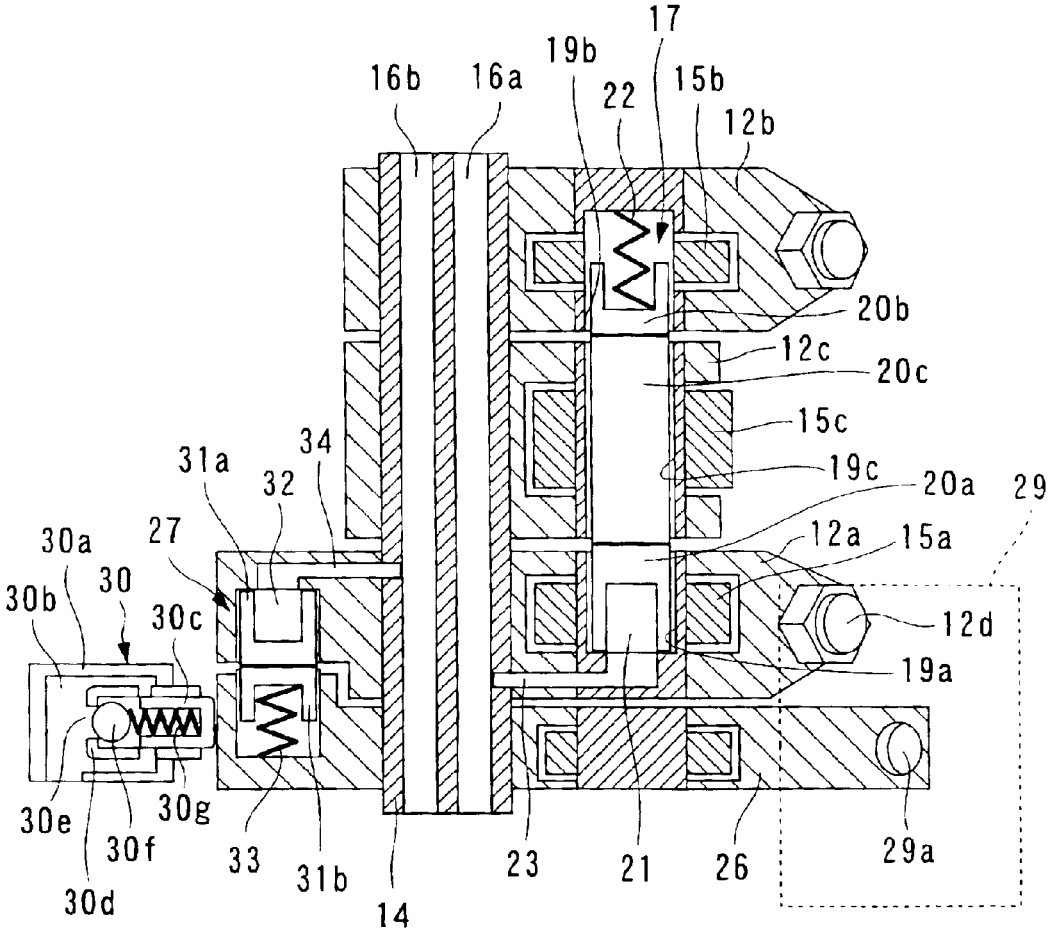
FIG. 4 is a cross-sectional view taken on line IV—IV in FIG. 3.

As shown in FIG. 4, the first switching valve 17 is formed by a piston valve, and has cylinders 19*a* to 19*c* formed continuous with each other at respective locations corresponding to the rollers 15*a* to 15*c* of the low-speed, inactive, and high-speed rocker arms 12*a* to 12*c*, and pistons 20*a* to 20*c* slidably arranged within these cylinders 19*a* to 19*c*, respectively, and in axial abutment with each other. The piston 20*a* has an oil chamber 21 formed therein on a side remote from the inactive rocker arm 12*b*, and a coil spring 22 is arranged between the piston 20*b* and the cylinder 19*b*, for urging the piston 20*b* toward the low-speed rocker arm 12*a*.

Further, the oil chamber 21 is communicated with the first oil pressure-switching mechanism 18 via an oil passage 23 formed through the low-speed rocker arm 12*a*, and the first oil passage 16*a* formed through the rocker shaft 14. The first oil pressure-switching mechanism 18 is comprised of an electromagnet valve and a spool (none of which is shown), and connected to an oil pump (not shown). The mechanism 18 is driven by a control signal from the ECU 2, for switching between the supply and cut-off of the oil pressure to the first switching valve 17 via the first oil passage 16*a*.

According to the above configuration, when the supply of oil pressure from the first oil pressure-switching mechanism 18 to the first switching valve 17 is cut off, the pistons 20*a* to 20*c* of the first switching valve 17 are held in respective positions shown in FIG. 4 by the urging force of the coil spring 22, and engaged only with the cylinders 19*a* to 19*c*, respectively. Therefore, the low-speed, inactive, and high-speed rocker arms 12*a* to 12*c* are disconnected from each other, and hence rotate independently of each other. As a result, with rotation of the camshaft 10, the low-speed rocker arm 12*a* is driven by the low-speed cam 11*a*, whereby the first intake valve IV1 is opened and closed in low-speed valve timing corresponding to the cam profile of the low-speed cam 11*a* (hereinafter referred to as "Lo. V/T"), while the inactive rocker arm 12*b* is driven by the inactive cam 12*b*, whereby the second intake valve IV2 is opened and closed in inactive valve timing by a slight valve lift corresponding to the cam profile of the inactive cam 11*b* (hereinafter referred to as "inactive V/T"). It should be noted that in the above case, although the high-speed rocker arm 12*c* is also driven by the high-speed cam 11*c*, since the first switching valve 17 mechanically disconnects between the high-speed rocker arm 12*c* and the low-speed rocker arm 12*a* and between the high-speed rocker arm 12*c* and the inactive rocker arm 12*b*, the operation of the high-speed rocker arm 12*c* does not affect the operations of the first and second intake valves IV1, IV2. Hereafter, such an operation mode of the two intake valves IV1, IV2 by the VTEC 13 is referred to as "Lo.-inactive V/T mode" as required. In the Lo.-inactive V/T mode, a swirl is produced in the cylinder 4, which flows from the first intake valve IV1 toward the second intake valve IV2, which ensures stable combustion even when the mixture is lean.

On the other hand, although not shown, when the oil pressure is supplied from the first oil pressure-switching mechanism to the oil chamber 21 of the first switching valve 17, the pistons of the first switching valve 17 are slid toward the coil spring 22 against the urging force thereof, whereby the piston 20*a* is engaged with the cylinders 19*a* and 19*c* in a bridging fashion, and at the same time the piston 20*c* in the center is engaged with the cylinders 19*b*, 19*c* in a bridging fashion. This connects the low-speed and inactive rocker arms 12*a*, 12*b* with the high-speed rocker arm 12*c* (not shown), and these arms are pivoted together. As a result, with rotation of the camshaft 10, the low-speed and inactive rocker arms 12*a*, 12*b* are driven via the high-speed rocker arm 12*c* by the high-speed cam 11*c* having the highest cam nose whereby both the first and second intake valves IV1, IV2 are opened and closed by a high-speed valve timing (hereinafter referred to as "Hi. V/T") corresponding to the cam profile of the high-speed cam 11*c*. Hereinafter, such an operation mode of the two intake valves IV1, IV2 by the VTEC 13 is referred to as "the HI. V/T mode" as required. In the Hi. V/T mode, both the first and second intake valves IV1, IV2 are opened and closed by a large lift, whereby the intake air amount is increased to deliver a larger power output.

Further, the cam-type valve actuating mechanism 6 for actuating the first and second exhaust valves EV1, EV2 is comprised of an exhaust camshaft 24, exhaust cams 25*a*, 25*b* fitted on the exhaust camshaft 24, exhaust rocker arms (not shown), and so forth, as shown in FIG. 1. The exhaust valves EV1, EV2 are opened and closed by valve lifts and in opening and closing timing corresponding to the cam profiles of the exhaust cams 25*a*, 25*b*. It should be noted that the cam-type valve actuating mechanism 6 may be also configured to be provided with a cam profile-switching mechanism to thereby switch the first and second exhaust valves EV1, EV2 between low-speed valve timing and high-speed valve timing.

The variable valve-closing timing device 7 includes a rocker arm 26 (holding rocker arm) for an electromagnetic actuator 29, referred to hereinafter, which is located adjacent to the low-speed rocker arm 12*a* and pivotally mounted on the rocker shaft 14. As shown in FIG. 4, this rocker arm (hereinafter referred to as "the EMA rocker arm") 26 protrudes farther outward than the low-speed and inactive rocker arms 12*a*, 12*b*. The variable valve-closing timing device 7 further includes a second switching valve 27 (switching mechanism) for hydraulically switching between the connection and disconnection of the EMA rocker arm 26 and the low-speed rocker arm 12*a*, and a second oil pressure-switching mechanism (switching mechanism) for switching between the supply and cut-off of oil pressure to the second switching valve 27, an electromagnetic actuator 29 for making blocking or latching engagement, via the EMA rocker arm 26 and the low-speed rocker arm 12*a*, with the first intake valve which has been opened, to hold the same, a hydraulic impact-lessening mechanism 30 for lessening an impact on the first intake valve IV1 which is caused by operation of the electromagnetic actuator 29, and a lost-motion spring 26*a* for preventing the EMA rocker arm 26 from pivotally moving downward by a follow-up spring 41, referred to hereinafter, of the electromagnetic actuator 29, when the EMA rocker arm 26 and the low-speed rocker arm 12*a* are disconnected from each other.

As shown in FIG. 4, the second switching valve 27 is formed by a piston valve, similarly to the first switching valve 17 of the VTEC 13, and includes pistons 31*a*, 31*b* slidably arranged for the low-speed and EMA rocker arms 12*a*, 26 and in axial abutment with each other, an oil chamber 32 formed in the piston 31*a*, and a coil spring 33 arranged between the piston 31*b* and the EMA rocker arm 26, for urging the piston 31*b* toward the low-speed rocker arm 12*a*. The oil chamber 32 is communicated with the second oil pressure-switching mechanism 28 via an oil passage 34 formed through the low-speed rocker arm 12*a* and the second oil passage 16*b* formed through the rocker shaft 14. The second oil pressure-switching mechanism 28 is, similarly to the first oil pressure-switching mechanism 18 of the VTEC 13, comprised of an electromagnetic valve and a spool (none of which is shown), and connected to an oil pump (not shown). The second oil pressure-switching mechanism 28 is driven by a control signal from the ECU 2, for switching between the supply and cut-off of the oil pressure to the second switching valve 27 via the second oil passage 6*b*, etc.

Therefore, during interruption of the supply of oil pressure from the second oil pressure-switching mechanism 28 to the second switching valve 27, the pistons 31*a*, 31*b* of the second switching valve 27 are held in respective positions shown in FIG. 4 by the urging force of the coil spring 33, in which the pistons 31*a*, 31*b* are engaged with the low-speed and EMA rocker arms 12*a*, 26 alone, respectively, whereby the two rocker arms 12*a*, 26 are disconnected from each other and pivoted independently of each other. On the other hand, although not shown, when the oil pressure is supplied from the second oil pressure-switching mechanism 28 to the oil chamber 32 of the second switching mechanism 27, the pistons 31*a*, 31*b* are slid toward the coil spring 33 against the urging force thereof, so that the piston 31*b* is engaged with the low-speed and EMA rocker arms 12*a*, 26 in a bridging fashion, whereby the two rocker arms 12*a*, 26 are connected with each other, and pivoted together.

Figure 5:
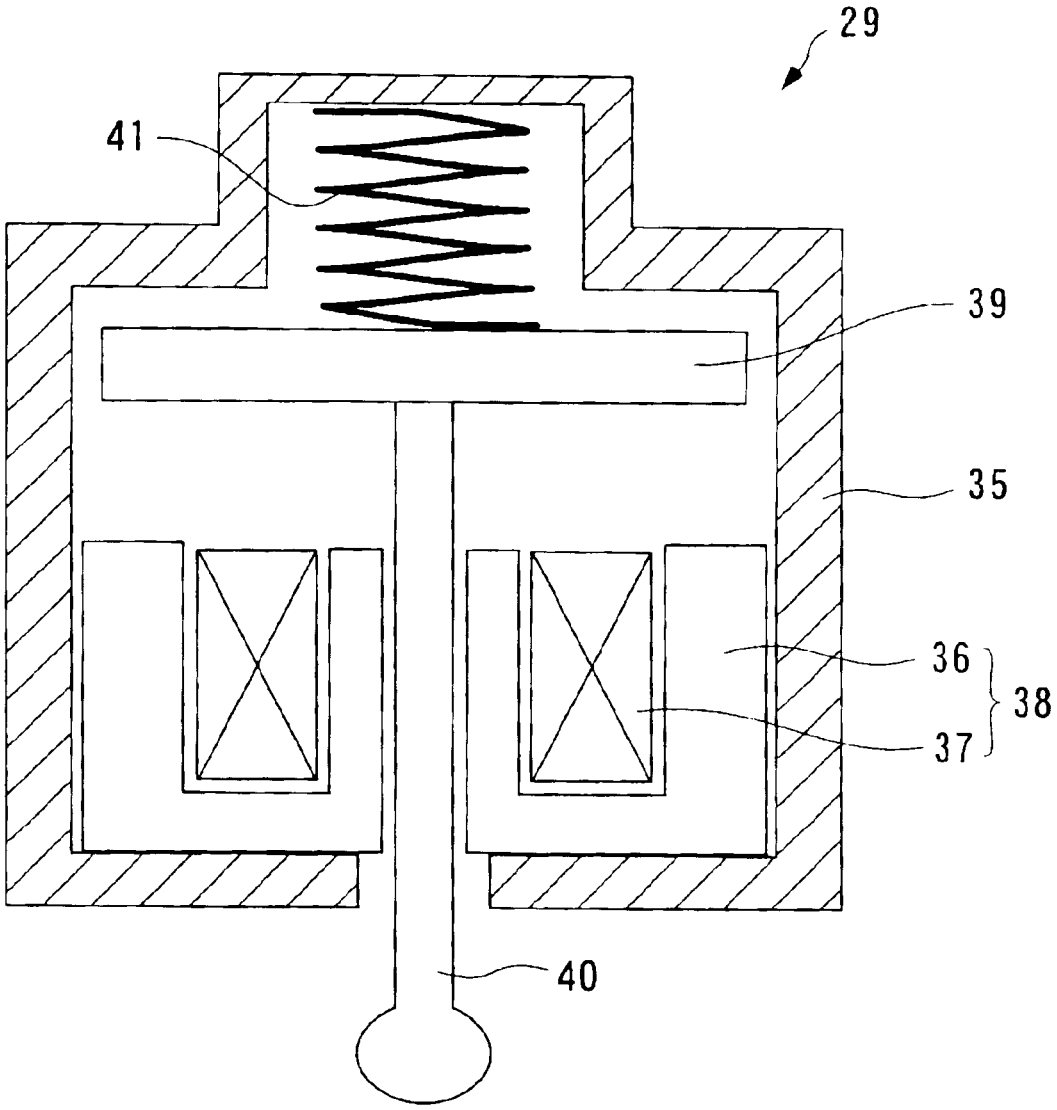
FIG. 5 is a cross-sectional view of an electromagnetic actuator.

As shown in FIG. 5, the electromagnetic actuator (hereinafter referred to as "the EMA") 29 as an actuator is comprised of a casing 35, an electromagnet 38 formed by a yoke 36 and a coil 37 received in a lower space within the casing 35, an armature 39 received above them, a stopper rod 40 (stopper) integrally formed with the armature 39 and extending downward through the electromagnet 38 and the casing 35 to the EMA rocker arm 26, and the follow-up coil spring 41 for urging the armature 39 downward such that the armature 39 follows motion of the EMA rocker arm 26. The coil 37 is connected to the ECU 2, and its energization is controlled by the ECU 2.

It should be noted that, as shown in FIGS. 3 and 4, an abutment portion 29*a* of the EMA rocker arm 26 with which the stopper 40 of the EMA 29 abuts is disposed at a location remoter from the rocker shaft 14 than an abutment portion 12*d* of the low-speed rocker arm 12*a* with which the first intake valve IV1 abuts. This configuration makes it possible to reduce the holing force required of the EMA 29 for holding the first intake valve IV1, thereby enabling reduction of the size of the EMA 29 and saving of energy. Further, since the EMA rocker arm 26 is a separate member from the low-speed rocker arm 12*a*, even if the abutment portion 12*d* is disposed as described above, it is possible to avoid an increase in the size of the low-speed rocker arm 12*a*, and the resulting increase in the inertial mass in an inactive mode of the EMA 26. Further, as the abutment portion 29*a* is disposed remoter from the rocker shaft 14 than the abutment portion 12*d*, the holding force of the EMA 29 can be made smaller, and as a result, the size of EMA 29 can be reduced.

According to the above configuration, when the ordinary valve-opening and closing operation by the camshaft 10, the second switching valve 27 disconnects between the low-speed and EMA rocker arms 12*a*, 26, so that the armature 39 and the stopper rod 40 press the EMA rocker arm 26 in a valve-lifting (valve-opening) direction (downward as viewed in FIG. 3) by the urging force of the follow-up coil 41. In this case, the EMA rocker arm 26 is held on a base circle of the camshaft 10 (in a state not lifting the first intake valve IV1), by the lost-motion spring 26 set to the larger spring force than that of the follow-up coil spring 41, whereby the EMA rocker arm 26 is held in a state connectable with the low-speed rocker arm 12*a*. As a result, the base circle of the camshaft 10 serves as a stopper, and restricts further motion of the EMA rocker arm 26, which prevents a larger urging force than required from acting on the EMA 29 and the hydraulic impact-lessening mechanism 30, so that durability of the EMA 29 and the hydraulic impact-lessening mechanism 30 can be improved.

On the other hand, when operating conditions set by the ECU 2 are satisfied, to attain the optimum valve-closing timing for the operating conditions, the second switching valve 27 is operated by the second oil pressure-switching mechanism 28, whereby the EMA rocker arm 26 is connected to the low-speed rocker arm 12*a* on the base circle of the camshaft 10. In this state, when the valve-opening and closing operation by the intake cam 11 is started, when the first intake valve IV1 is moving in the valve-lifting direction, the EMA rocker arm 26 is driven downward by the intake cam 11 against the urging force of the lost-motion spring 26*a*, and accordingly, the armature 39 and the stopper rod 40 are lifted by the follow-up coil spring 41 in a fashion following the EMA rocker arm 26. Further, in parallel with this, the coil 37 is energized in appropriate timing to magnetize the yoke 36. Then, immediately before the first intake valve IV1 reaches the maximum lift (e.g. 0.01 to 0.85 mm), the armature 39 is seated on the yoke 36 (CRK1 in FIG. 6), and thereafter, the EMA rocker arm 26 leaves the stopper rod 40. Then, by the time the first intake valve IV1 is brought into abutment with the stopper rod 40 again after reaching the maximum lift (CRK3 in FIG. 6), the magnetized state of the yoke 36 is established (CRK2 in FIG. 6), so that the armature 39 maintains a state seated on the yoke 36 by the holding force of the yoke 36 which overcomes the urging force of the coil spring 3*c* of the first intake valve IV1. As a result, the first intake valve IV1 is brought into blocking (or catching) engagement with the stopper rod 40 via the low-speed rocker arm 12*a* and the EMA rocker arm 26, and held in an open state by a predetermined lift (hereinafter referred to as "the holding lift") VLL corresponding to a protruded position of the stopper rod 40.

Further, thereafter, when the holding of the first intake valve IV1 by the EMA 29 is canceled by stopping the energization of the coil 37 and thereby demagnetizing the yoke 36, the first intake valve IV1 is closed by the urging force of the coil spring 3*c*. Therefore, the operation of the EMA 29 makes it possible not only to close the first intake valve IV1 later than when the first intake valve IV1 is actuated by the intake cam 11, and but also to control the closing timing of the first intake valve IV1 as desired by controlling the timing of turning-off of the coil 37.

The hydraulic impact-lessening mechanism 30 lessens the impact applied when the first intake valve IV1 is closed upon cancellation of the holding of the same by the EMA 29. As shown in FIGS. 3 and 4, the hydraulic impact-lessening mechanism 30 is comprised of a casing 30*a* defining an oil chamber 30*b* therein, a piston 30*c* horizontally slidably inserted into the oil chamber 30*b* with one end protruding out from the casing 30*a*, a valve chamber 30*d* arranged within the oil chamber 30*b* and formed with a port 30*e* on a side remote from the piston 30*c*, a ball 30*f* received within the valve chamber 30*d*, for opening and closing the port 30*e*, and a coil spring 30*g* arranged between the ball 30*f* and the piston 30*c*, for urging the piston 30*c* outward. The piston 30*c* is in abutment with an upward-extending portion of the EMA rocker arm 26 on an opposite side to the abutment portion 29*a* with which the stopper rod 40 of the EMA 29 abuts.

According to the configuration described above, the hydraulic impact-lessening mechanism 30 is in a state shown in FIG. 3 when the intake valve IV1 is closed, that is, since the EMA rocker arm 26 has been pivoted in an anticlockwise direction as viewed in the figure, the piston 30*c* is positioned leftward, whereby the coil spring 30*g* is compressed, and the ball 30*f* closes the port 30*e*. From this state, when the intake valve IV1 is moved in the valve-opening direction, the EMA rocker arm 26 is pivoted in a clockwise direction, whereby the piston 30*c* is slid rightward. In accordance therewith, the ball 30*f* opens the port 30*e* to allow oil to fill the valve chamber 30*d*, and the coil spring 30*g* is expanded. Then, when the first intake valve IV1 is moved in the valve-closing direction after cancellation of the holding thereof by the EMA 29, the EMA rocker arm 26 is braked by the urging force of the coil spring 30*g* and the oil pressure, whereby the impact on the first intake valve IV1 is lessened.

On the other hand, a crankshaft angle sensor 42 (operating condition-detecting means) is arranged around the crankshaft. The crankshaft angle sensor 42 delvers a CYL signal, a TDC signal, and a CRK signal, as pulse signals, at respective predetermined crank angle positions to deliver the same to the ECU 2. The CYL signal is generated at a predetermined crank angle position of a particular cylinder. The TDC signal indicates that the piston (not shown) of each cylinder 4 is at a predetermined crank angle position in the vicinity of the TDC (top dead center) position at the start of the intake stroke of the piston, and in the case of the four-cylinder engine of the present embodiment, one pulse of the TDC signal is delivered whenever the crankshaft rotates through 180 degrees. Further, the CRK signal is generated at a shorter cycle than that of the TDC signal i.e. whenever the crankshaft rotates through e.g. 30 degrees. The ECU 2 determines the respective crank angle positions of the cylinders on a cylinder-by-cylinder basis, based on these CYL, TDC, and CRK signals, and calculates the rotational speed (hereinafter referred to as "the engine rotational speed") Ne based on the CRK signal.

Further input to the ECU 2 are a signal indicative of an accelerator opening ACC which is a stepped-on amount of an accelerator pedal (not shown) from an accelerator opening sensor 43 (operating condition-detecting means) and a signal indicative of a valve lift VL of the first intake valve IV1 from a lift sensor 44.

Now, the operations of the valve control apparatus 1 described heretofore will be described collectively with reference to FIG. 6. This figure shows an example of a case in which the first intake valve IV1 and the second intake valve IV2 are opened and closed in Lo. V/T and inactive V/T, respectively. As shown in the figure, the first and second exhaust valves EV1, EV2 are actuated by following the respective cam profiles of the exhaust cams 25*a*, 25*b*, whereby they start to open at a crank angle position slightly before their BDC before the exhaust stroke and terminate closing slightly after their TDC before the intake stroke. The second intake valve IV2 is opened by the inactive cam 11*a* following its cam profile by a very small lift during an end portion of the intake stroke.

Further, the intake valve IV1 is actuated by the low-speed cam 11*a* following its cam profile, thereby starting to open slightly before the TDC before the intake stroke, and when the EMA 29 is inactive, terminates its closing operation slightly after its BDC before the compression stroke (hereinafter after referred to as "BDC closing"). On the other hand, when the EMA 29 is active, the coil 37 starts to be energized in timing before the lift VL of the first intake valve IV1 reaches the aforementioned holding lift VLL. This energization start timing is made earlier as the engine rotational speed NE is higher, so as to enable time to be secured which is necessary for operation of the EMA 29. For example, the latest timing is set to approximately the same timing as the armature 39 is seated (CRK1 in FIG. 6) and the earliest timing is set to timing (CRK0 in FIG. 6) earlier than the TDC. This establishes the magnetized state of the yoke 36 in a predetermined timing after the armature 39 of the EMA 29 is seated on the yoke 36 (CRK2). In the meanwhile, the lift VL of the first intake valve IV1 undergoes changes following the cam profile of the low-speed cam 11*a*, and when it is equal to the holding lift VLL after passing the maximum lift, the EMA rocker arm 26 is brought into blocking engagement with the stopper rod 40, whereby it is held at the holding lift VLL (CRK3).

Thereafter, until the energization of the coil 37 is stopped, the lift VL of the first intake valve IV1 is held at the holding lift VLL, so that the low-speed cam 11*a* is moved away from the low-speed rocker arm 12*a* and freely rotates. Then, the coil 37 is turned off (e.g. CRK4) to decrease the magnetic force acting on the armature 39, whereby the first intake valve IV1 is liberated from the holding by the EMA 29 (CRK5), and is moved by the spring force of the coil spring 3*c* along the valve lift curve VLDLY1 to the valve-closing position. After that, at a crank angle position (CRK6) slightly before the valve-closing position, the hydraulic impact-lessening mechanism 30 starts to act to thereby decelerate the first intake valve IV1, which finally reaches the valve-closing position in a cushioned state (CRK7).

Figure 6:
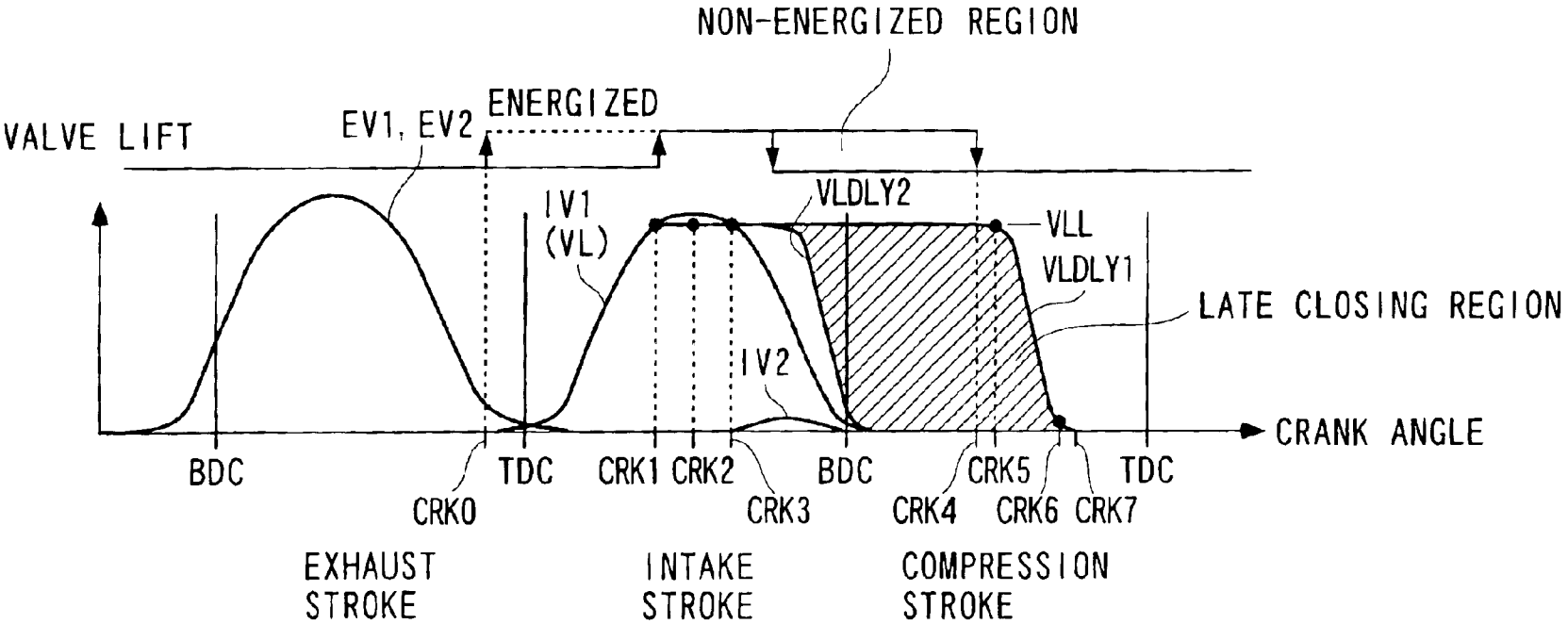
FIG. 6 is a diagram showing an example of operations of intake and exhaust valves performed with the valve control apparatus.

It should be noted that the valve lift curve VLDLY1 mentioned above represents a case of the coil 37 being turned off latest, and a valve lift curve VLDLY2 in FIG. 6 represents a case of the coil 37 being turned off earliest. That is, the hatched area enclosed by the two valve lift curves VLDLY1, VLDLY2 represents a late closing region of the first intake valve IV1 in which the late closing can be carried out by the variable valve-closing timing device 7. Thus, by controlling the timing in which the coil 37 is turned off, the closing timing of the first intake valve IV1 can be controlled as desired within this late closing region.

Figure 7:
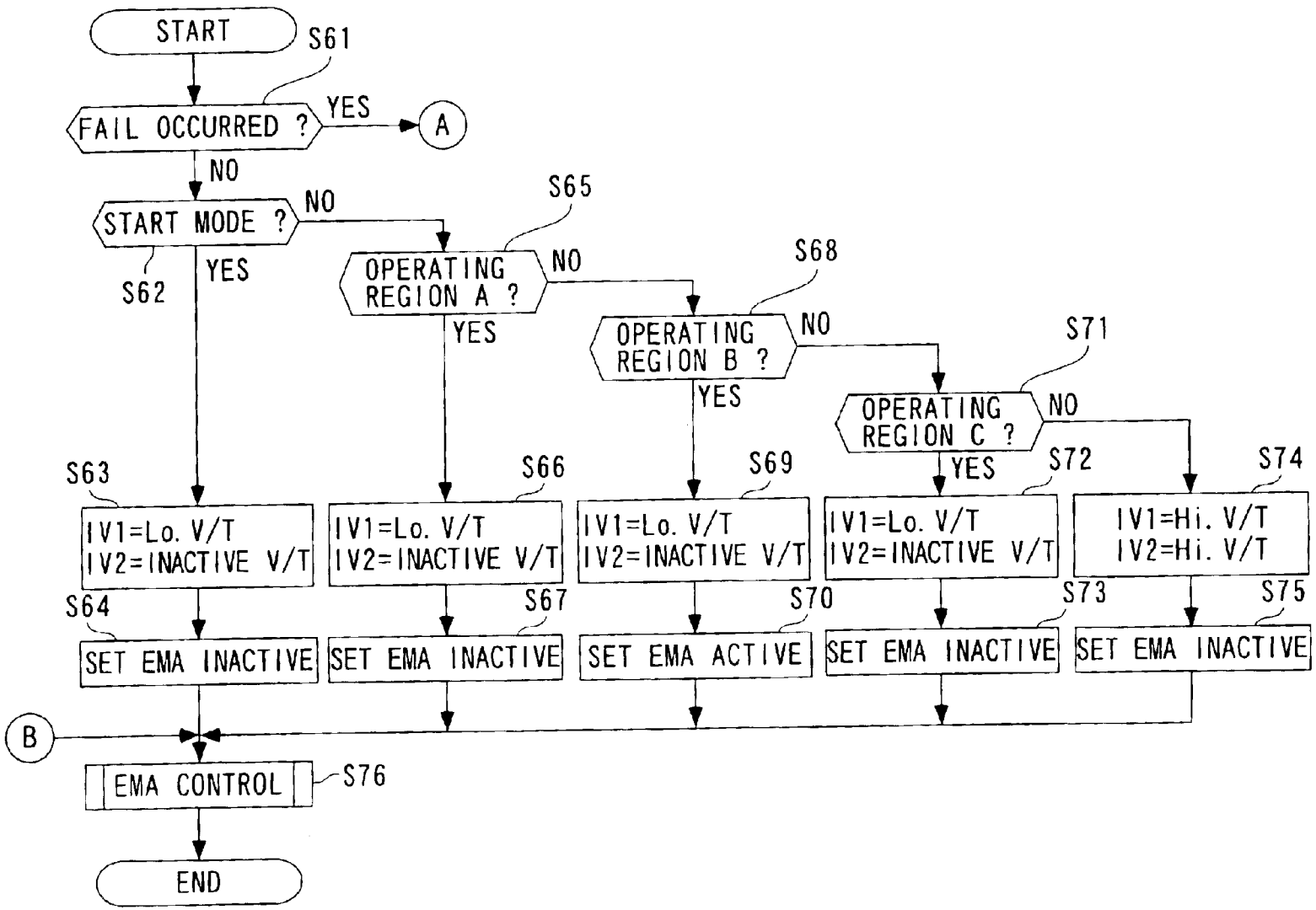
FIG. 7 is a flowchart of a valve control process executed by an ECU appearing in FIG. 1.
Figure 8:
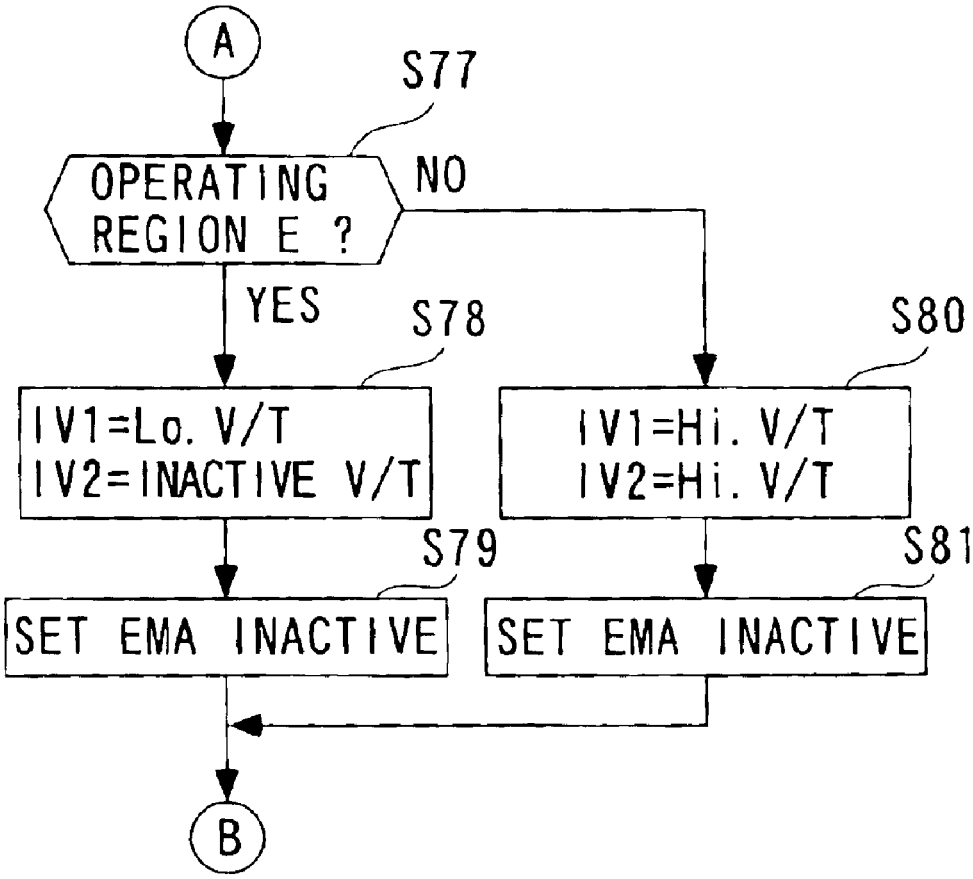
FIG. 8 is a flowchart of part of the FIG. 7 valve control process.

The ECU 2 in the present embodiment forms control means, operating condition-detecting means, and operation mode-determining means, and is implemented by a microcomputer comprised of a CPU, a RAM, a ROM, and an input/output interface (none of which is shown). The above-mentioned signals indicative of detections by the sensors 42 to 44 are input to the CPU after A/D conversion and shaping by the input/output interface. The CPU determines operating conditions of the engine 3 by control programs stored in the ROM according to these input signals, and controls the operations of the variable valve-closing timing device 7 and the VTEC 13 in the following manner:

FIGS. 7 and 8 shows a flowchart of a valve control process which is executed by the ECU 2 whenever the TDC signal pulse is generated. In this valve control process, first in a step 61 (in the figures, shown as "S61", which rule applies similarly in the following description), it is determined whether or not a fail has occurred on the EMA 29. This determination is carried out e.g. based on the lift VL of the first intake valve IV1 detected by the lift sensor 44. More specifically, when the EMA 29 is to be operated, if the lift VL is not held at the holding lift VLL, judging that the EMA 29 is in an inoperative state, or when the lift VL continues to be held at the holding lift VLL for more than a predetermined time period, judging that the stopper rod 40 of the EMA 29 is in a state incapable of returning to a withdrawn position (inactivation incapable state), it is determined that a fail has occurred on the EMA 29.

If the answer to the question of the step 61 is negative (NO), i.e. if no fail has occurred on the EMA 29, it is determined whether or not the engine 3 is in a start mode (step 62). This determination is carried out e.g. based on the engine rotational speed Ne, and when the engine rotational speed Ne is equal to or lower than a predetermined rotational speed (e.g. 500 rpm), it is determined that the engine is in the start mode. If the answer to this question is affirmative (YES), and hence the engine 3 is in the start mode, the valve timing of the first intake valve IV1 and that of the second intake valve IV2 are set to Lo. V/T and inactive V/T, respectively, by the VTEC 13 (step 63), and the EMA 29 is set to the inactive mode (step 64). That is, when the engine 3 is in the start mode, the EMA 29 is made inactive.

Figure 9:
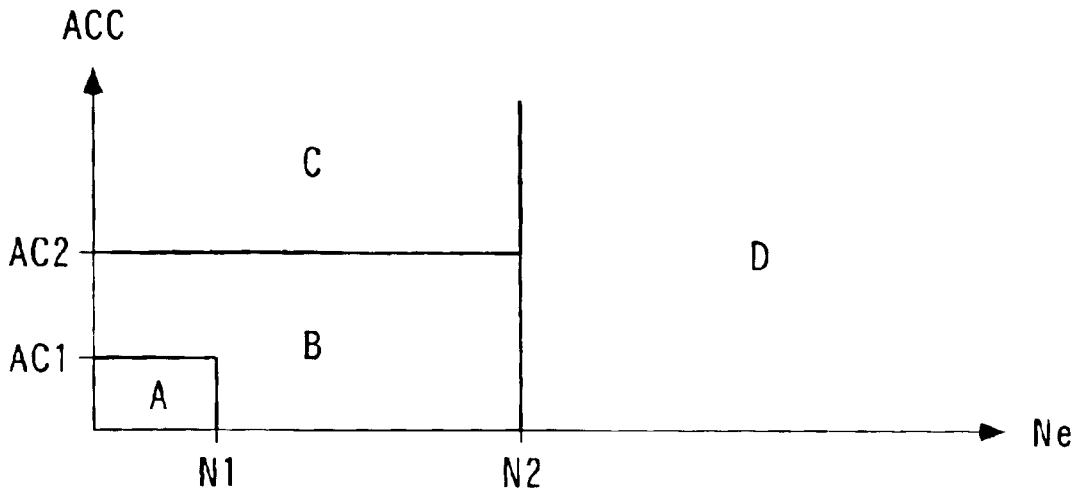
FIG. 9 shows an example of an operating region map employed in the FIG. 7 valve control process.

On the other hand, if the answer to the question of the step 62 is negative (NO), i.e. if the engine 3 is not in the start mode, it is determined whether or not the engine 3 is in an operating region A (step 65). FIG. 9 shows an example of a map defining operating regions of the engine 3. The operating region A corresponds to an idle operating region in which the engine rotational speed Ne is lower than a first predetermined value N1 (e.g. 800 rpm) and the accelerator opening ACC is lower than a first predetermined value AC1 (e.g. 10%), an operating region B corresponds to a low-rotational speed/low-load region in which the Ne value is lower than a second predetermined value N2 (e.g. 3500 rpm) and the ACC value is lower than a second predetermined value AC2 (e.g. 80%), exclusive of the operating region A, an operating region C corresponds to a low-rotational speed/high-load region in which the Ne value is lower than the second predetermined value N2 and the ACC value is equal to or higher than the second predetermined value AC2, and an operating region D correspond to a high-rotational speed region in which the Ne value is equal to or higher than the second predetermined value N2.

If the answer to the question of the step 65 is affirmative (YES) and hence the engine 3 is in the operating region A (idle operating region), similarly to the case of the engine 3 being in the start mode, the first and second intake valves IV1, IV2 are set to Lo. V/T and inactive V/T, respectively (step 66) and the EMA 29 is set to the inactive mode (step 67).

If the answer to the question of the step 65 is negative (NO), it is determined whether or not the engine 3 is in the operating region B (step 68). If the answer to this question is affirmative (YES), the first and second intake valves IV1, IV2 are set to Lo. V/T and inactive V/T (step 69), similarly to the case of the engine 3 being in the idle operating region, whereas the EMA 29 is set to the active mode (step 70). In other words, when the engine 3 is in the low-rotational speed/low-load region, the EMA 29 is made active whereby the first intake valve IV1 is controlled to late closing. This makes it possible to retard the closing timing of the first intake valve IV1, thereby reducing pumping loss and improving fuel economy.

If the answer to the question of the step S68 is negative (NO), it is determined whether or not the engine 3 is in the operating region C (step 71). If the answer to the question is affirmative (YES), the first and second intake valves IV1, IV2 are set to Lo. V/T and inactive V/T, respectively (step 72), whereas the EMA 29 is set to the inactive mode (step 73). In other words, when the engine is in the low-rotational speed/high-load region, the EMA 29 is made inactive, whereby the closing timing of the first intake valve IV1 is set to the BDC closing by the low-speed cam 11*a*, whereby the actual stroke volume can be increased to increase the power output.

If the answer to the question of the step S71 is negative (NO), i.e. if the engine 3 is in the operating region D, the first and second intake valves IV1, IV2 are both set to Hi. V/T (step 74) and the EMA 29 is set to the inactive mode (step 75). In other words, when the engine is in the high-rotational speed region, the first and second intake valves IV1, IV2 are set to Hi. V/T, whereby the lift is increased to increase the amount of intake air, and the closing timing of the first intake valve IV1 is set to the BDC closing to increase the actual stroke volume, which makes it possible to increase the power output to the maximum.

Figure 10:
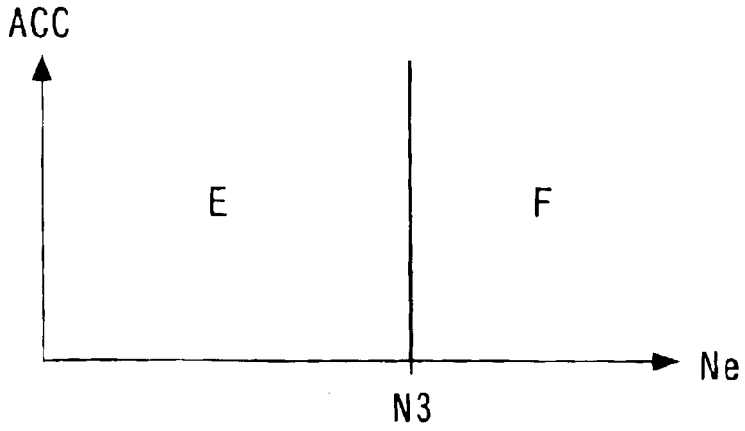
FIG. 10 shows an example of an operating region map used in occurrence of a fail.

On the other hand, if the answer to the question of the step S61 is affirmative (YES), i.e. if a fail has occurred on the EMA 29, the program proceeds to a step 77 in FIG. 8, wherein it is determined whether or not the engine 3 is in an operating region E. FIG. 10 shows a table defining an example of operating regions of the engine applied to the valve control process when a fail has occurred, in which the operating region E corresponds to a low-rotational speed region in which the engine rotational speed Ne is lower than a third predetermined value N3 (e.g. 3500 rpm), and an operating region F correspond to a high-rotational speed region in which the Ne value is equal to or higher than the third predetermined value N3.

If the answer to the question of the step S77 is affirmative (YES), and hence the engine 3 is in the operating region E (low-rotational speed region), the first and second intake valves IV1, IV2 are set to Lo. V/T and inactive V/T, respectively (step 78), and the EMA 29 is set to the inactive mode (step S79). On the other hand, if the answer to the question of the step S77 is negative (NO), and hence the engine 3 is in the operating region F, the first and second intake valves IV1, IV2 are both set to Hi. V/T (step 80), and the EMA 29 is set to the inactive mode (step 81). As described above, when a fail has occurred on the EMA 29, the EMA 29 is made inactive, whereby the fail of the EMA 29 is prevented from causing adverse effects on the operations of the first and second intake valves IV1, IV2, and the valve timing of these valves is switched depending on the rotational speed region of the engine 3, whereby the first and second intake valves IV1, IV2 can be actuated by the cam-type valve actuating mechanism 5 without any trouble.

Referring again to FIG. 7, in a step 76 following the step 64, 67, 70, 73, 75, 79, or 81, a control process for the EMA 29 (hereinafter referred to as "the EMA control process") is carried out. In the EMA control process, according to the active mode of the EMA 29 set in the step S64, 67, 70, 73, 75, 79, or 81, whether the EMA 29 is to be made active or inactive is determined, and when the EMA 29 is to be made active, the energization of the respective coils 37 of the respective EMAs (EMA1 to EMA4) of the four cylinders 4 is controlled.

Figure 11:
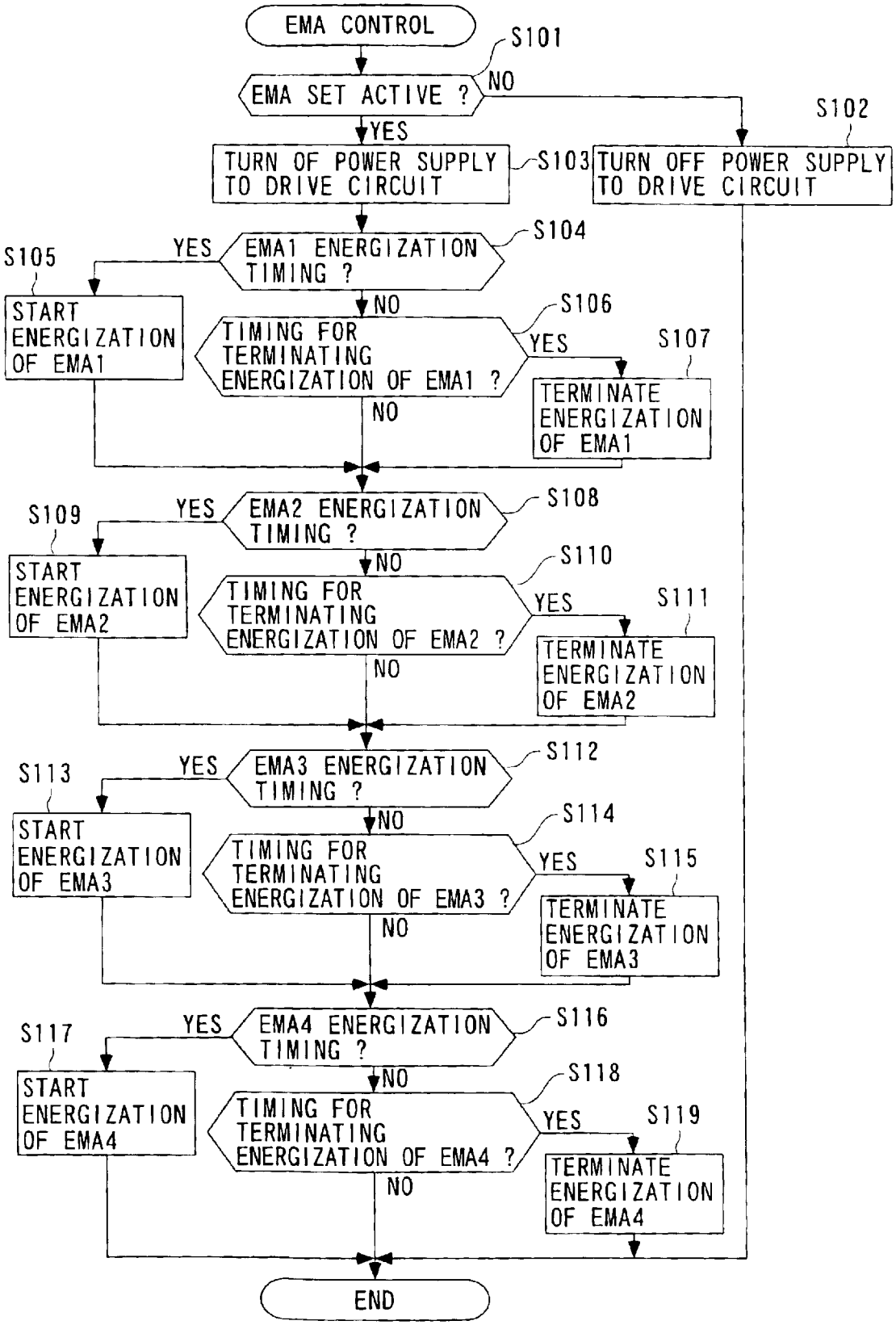
FIG. 11 is a flowchart of a control process for controlling an electromagnetic actuator.

FIG. 11 shows a subroutine of the EMA control process. In this process, first, it is determined whether or not the operation mode of the EMA 29 has been set to the active mode (step 101). If the answer to this question is negative (NO), and hence the EMA 29 has been set to the inactive mode, a power supply to a drive circuit (none of which is shown) for supplying electric current to the coil 37 of the EMA 29 and the second oil pressure-switching mechanism 28 is turned off (step 102), followed by terminating the present program. This makes the EMA 29 inactive by stopping energization of the coil 37 when the EMA 29 has been set to the inactive mode. Further, in this case, even if the EMA 29 cannot be made inactive by stopping energization of the coil 37 due to a fail having occurred on the EMA 29 itself, the low-speed rocker arm 12*a* is made free from the EMA rocker arm 26 by stopping supply of electric current to the second oil pressure-switching mechanism 28, thereby stopping the second switching valve 27 from operating. As a result, the EMA 29 is no longer connected with the first intake valve IV1, and hence incapable of holding the same. This enables the first intake valve IV1 to be actuated by the cam-type valve actuating mechanism 5 without any trouble while positively preventing the fail of the EMA 29 from causing adverse effects on the operation of the first intake valve IV1.

On the other hand if the answer to the question of the step 101 is affirmative (YES), and hence the EMA 29 has been set to the active mode, the power supply to the drive circuit is turned on (step 103), whereby the coil 37 is made energizable, and by driving the second oil pressure-switching mechanism 28, the second switching valve 27 is operated, whereby the low-speed rocker arm 12*a* and the EMA rocker arm 26 are connected to each other.

Next, it is determined whether or not the EMA1 is in timing for starting energization (step 104), and when the answer to this question becomes affirmative (YES), the EMA1 starts to be energized (step 105). The timing for starting the energization is set according to the engine rotational speed Ne, as described hereinabove. If the answer to the question of the step 104 is negative (NO), it is determined whether or not the EMA1 is in timing for terminating the energization (step 106). When the answer to this question becomes affirmative (YES), the energization of the EMA1 is terminated (step 107). The timing for termination of the energization is set according to the engine rotational speed Ne and the accelerator opening ACC, as described hereinbelow.

Thereafter, similarly to the above, in steps 108 to 111, steps 112 to 115, and steps 116 to 119, the start and termination of the energization of the EMA2 to EMA4 are controlled, respectively, followed by terminating the program.

Figure 12:
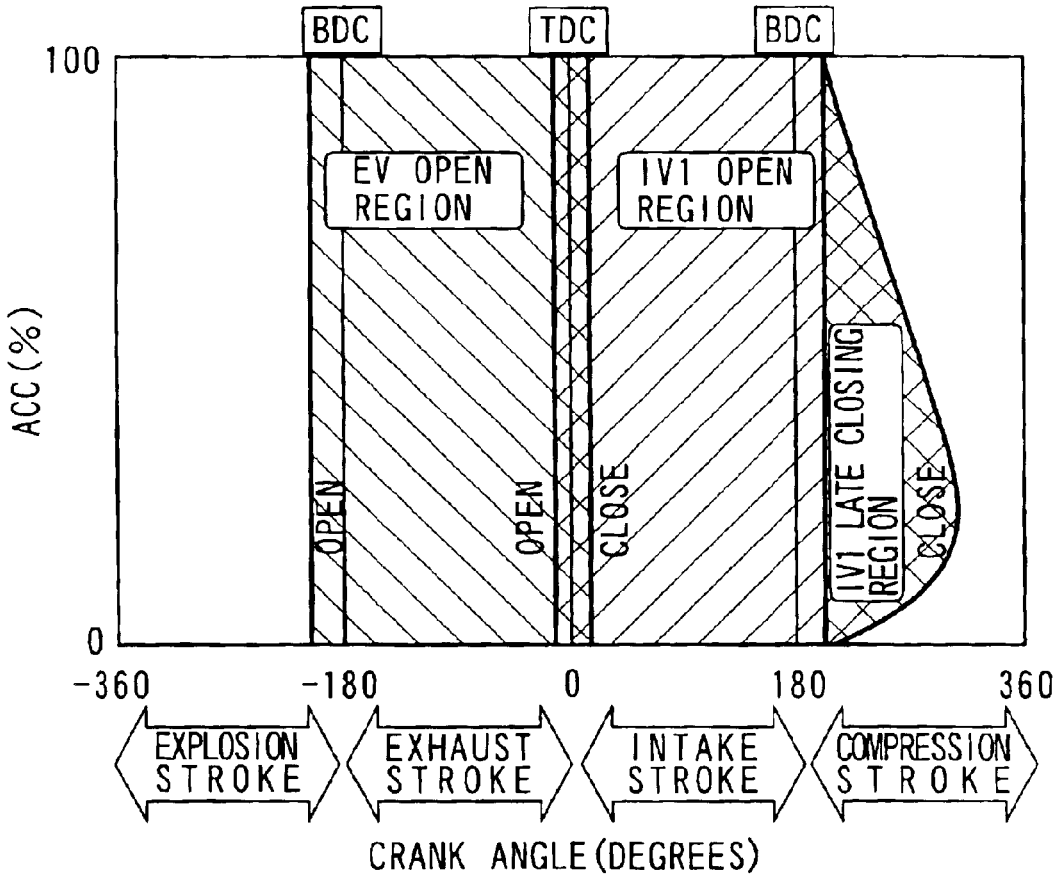
FIG. 12 is a diagram showing an example of settings of valve-closing timing of a first intake valve in a low engine rotational speed condition.

FIG. 12 shows an example of the closing timing of the first intake valve IV1 under the low rotational speed condition (e.g. 1500 rpm). As shown in the figure, the closing timing of the first intake valve IV1 is basically set to later timing as the load on the engine represented by the accelerator opening ACC is lower, and for example, when the accelerator opening ACC is around 20%, the intake valve IV1 is set to very late closing timing of about BDC+130 degrees. This can minimize the pumping loss in the low-rotational speed/low-load region in which the engine is frequently operated, whereby the improvement in fuel economy can be made maximum. Further, the valve-closing timing is configured such that as the load increases, it progressively approaches the BDC, whereby the power output can be increased. It should be noted that the region for late closing is narrowed for the very small load condition in order to cope with the problem of combustion fluctuation by making the valve-closing timing earlier, since the combustion fluctuation tends to start to occur when the engine is under the very low load condition.

As described above, according to the valve control apparatus of the present embodiment, the cam-type valve actuating mechanism 5 actuates the first and second intake valves IV1, IV2, and the EMA 29 is operated as required, whereby the closing timing of the first intake valve IV1 can be controlled as desired. This makes it possible to attain the maximum fuel economy and power output in a manner adapted to any operating conditions of the engine. That is, as described above, in the low-rotational speed/low-load operating region, the closing timing of the first intake valve IV1 is controlled to late closing in a manner adapted to each of possible cases of the operating conditions of the engine 3, whereby the pumping loss can be minimized, and hence the fuel economy can be largely improved. Further, in the high-rotational speed/high-load region, the EMA 29 is made inactive, and the first intake valve IV1 is actuated by the cam-type valve actuating mechanism 5 alone, whereby higher rotational speed and higher power output can be realized without being affected by the follow-up capability of the EMA 29.

Further, the first intake valve IV1 is basically actuated by the cam-type valve actuating mechanism 5, and the EMA 29 is only required to block the first intake valve IV1 by one electromagnet 38 in one direction, and hence one electromagnet 38 is sufficient for one cylinder 4, which allows reduction of weight and cost of the apparatus. Further, since the EMA 29 is operated only when the operating conditions thereof are satisfied, this merit and the use of one electromagnet 38 make it possible to reduce the electric power consumption, and further improve the fuel economy by the reduction of the electric power consumption.

Moreover, since the first intake valve IV1 can be operated by the cam-type valve actuating mechanism 5 alone, even when a fail, such as loss of synchronization, has occurred on the EMA 29, the first intake valve IV1 can be actuated by the cam-type valve actuating mechanism 5 without any trouble. Further, even if the EMA 29 cannot be made inactive due to the fail, it is possible to forcibly make the EMA 29 incapable of making blocking engagement with the first intake valve IV1, by stopping the supply of current to the second oil pressure-switching mechanism 28. Therefore, it is possible to positively prevent the fail of the EMA 29 from adversely affecting the first intake valve IV1, and prevent degradation of combustion state and resulting increase in exhaust emissions.

Further, at the start of the engine 3 during which it takes time to increase oil pressure, the EMA 29 is made inactive, and the first intake valve IV1 is actuated by the cam-type valve actuating mechanism 5 alone, which ensures the stable operation of the first intake valve IV1.

Further, the hydraulic impact-lessening mechanism 30 lessens the impact received by the first intake valve IV1 when it returns to the valve-closing position after cancellation of the holding thereof by the EMA 29, and noise caused by the impact can be suppressed. In this case, when the hydraulic oil is in a very low temperature condition or high temperature condition in which the viscosity of the hydraulic oil is liable to change and hence the impact-lessening performance may not be maintained, the EMA 29 is made inactive to thereby fully ensure the impact-lessening performance of the mechanism 30.

Figure 13:
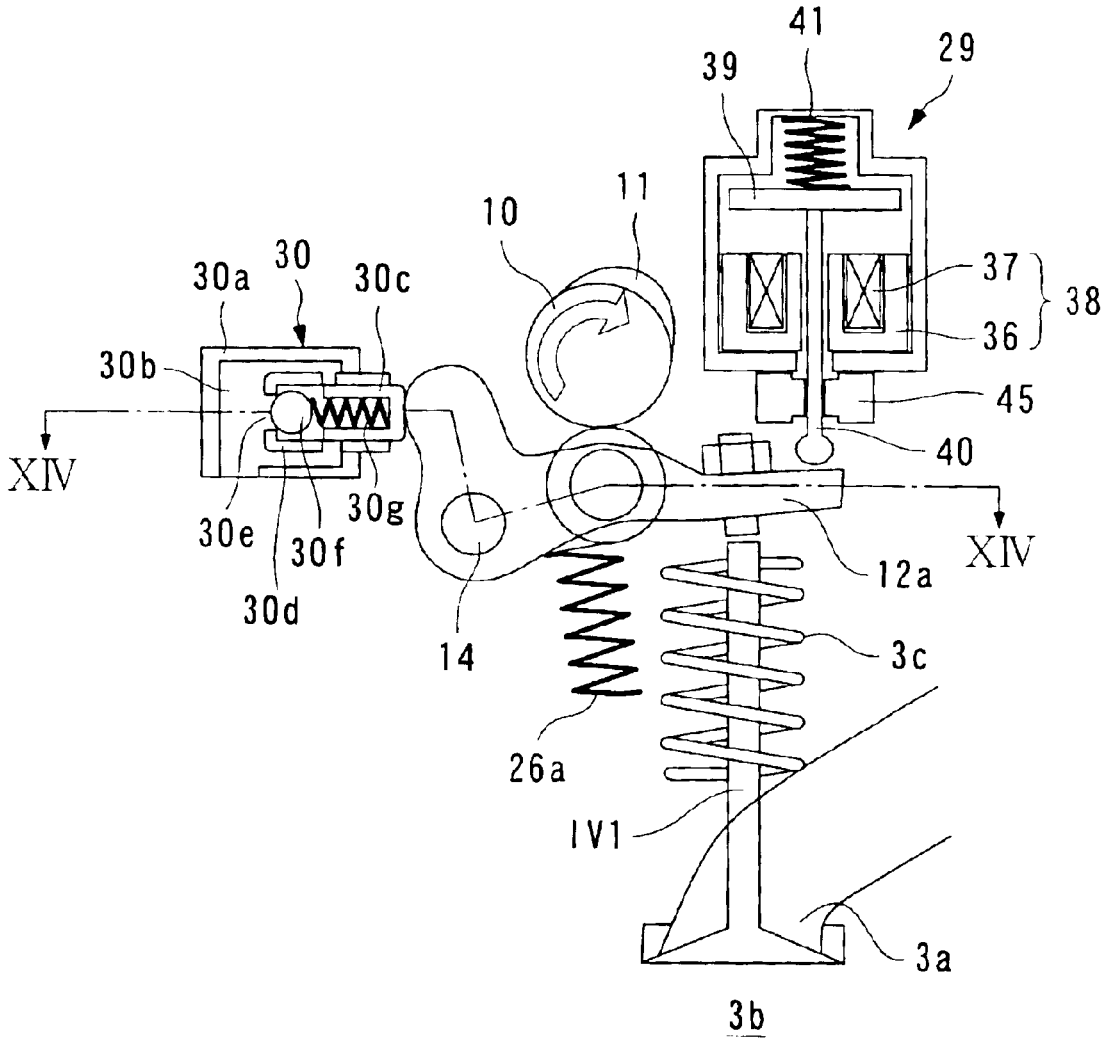
FIG. 13 is a side view of a valve control apparatus for an internal combustion engine, according to a second embodiment of the invention.
Figure 14:
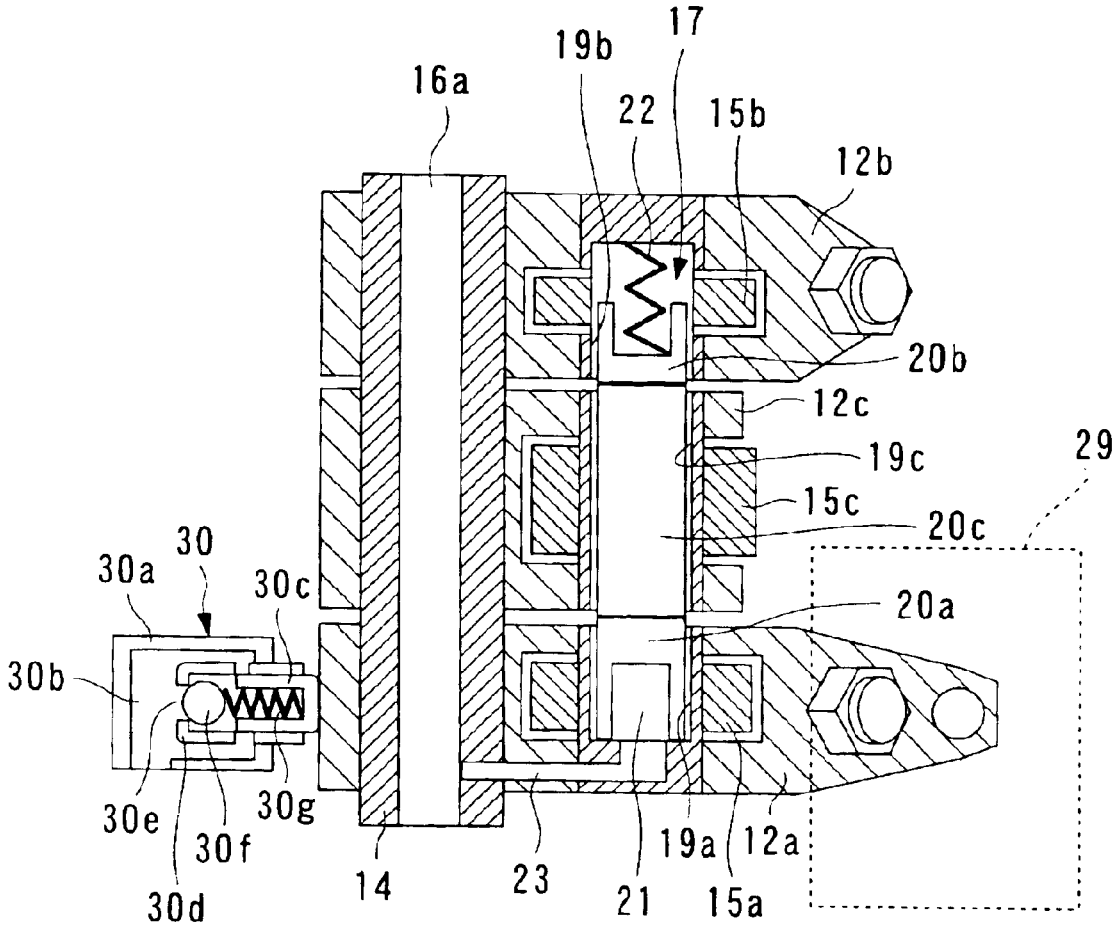
FIG. 14 is a cross-sectional view taken on line XIV—XIV in FIG. 13.

FIGS. 13 and 14 show a valve control apparatus according to a second embodiment of the invention. This embodiment is distinguished from the first embodiment in which the EMA rocker arm 26 is used, in that the EMA rocker arm 26 is removed, but the EMA 29 is caused to directly act on the low-speed rocker arm 12*a*. In accordance with the removal of the EMA rocker arm 26, the second switching valve 27 and the second oil pressure-switching mechanism 28 for causing the EMA rocker arm 26 to be connected with the low-speed rocker arm 12*a* are also removed, and the rocker shaft 14 is formed with only the first oil passage 16 for the VTEC 13. Further, the hydraulic impact-lessening mechanism 30 has its piston 30*c* in abutment with the low-speed rocker arm 12*a*, and the impact on the first intake valve IV1 is lessened via the low-speed rocker arm 12*a*. Further, the EMA 29 has an hydraulic inactivating mechanism 45 (switching mechanism) attached thereto, for making the EMA 29 inactive. The hydraulic inactivating mechanism 45 is controlled by the ECU 2, and is configured to hydraulically lock the stopper rod 40 during operation thereof, and the other features of the arrangement of the apparatus is the same as those of the first embodiment.

Therefore, in the present embodiment as well, the operation modes of the first and second intake valves IV1, IV2 can be switched between the Lo.-inactive V/T mode and the Hi. V/T mode, and by causing the EMA 29 to directly make blocking engagement with the low-speed rocker arm 12*a*, the closing timing of the first intake valve IV1 can be changed as desired. Therefore, the same effects of the first embodiment described above can be obtained. Further, when a fail has occurred on the EMA 29, the hydraulic inactivating mechanism 45 is operated, whereby the EMA 29 can be forcibly made inactive, so that the first intake valve IV1 can be actuated by the cam-type valve actuating mechanism 5 without any trouble. The present embodiment is particularly advantageous in the case where the EMA rocker arm cannot be added to the cam-type valve actuating mechanism 5 due to the layout or other constraints.

Figure 15:
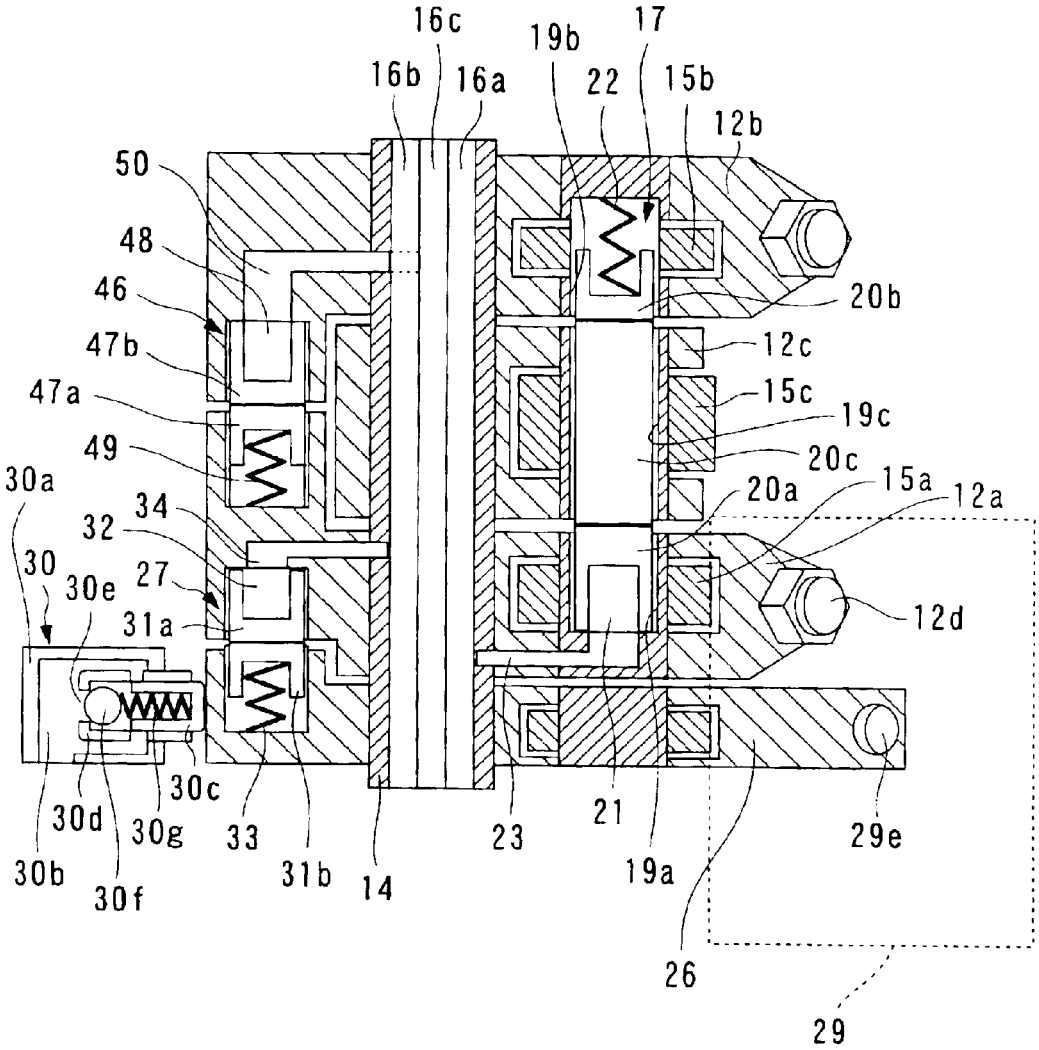
FIG. 15 is a cross-sectional view of a valve control apparatus for an internal combustion engine, according to a third embodiment of the invention.

FIG. 15 shows a valve control apparatus according to a third embodiment of the invention. This embodiment is distinguished from the first embodiment in construction of the VTEC 13, i.e. in that the VTEC 13 of the present embodiment includes a third switching valve 46 for switching between the connection and disconnection of the low-speed rocker arm 12*a* and the inactive rocker arm 12*b*, in addition to the first switching valve 17, whereby it is configured that the first and second intake valves IV1, IV2 can be simultaneously opened and closed in Lo. V/T.

The third switching valve 46 basically has the same construction as the first switching valve 17, that is, it includes pistons 47*a*, 47*b* slidably provided for the low-speed and inactive rocker arms 12*a*, 12*b*, an oil chamber 48 formed in a piston 47*b*, and a coil spring 49 for urging the piston 47*a* toward the inactive rocker arm 12*b*. The oil chamber 48 is communicated with the third oil pressure-switching mechanism (not shown) via an oil passage 50 formed through the inactive rocker arm 12*b* and a third oil passage 16*c* formed through the rocker shaft 14. This third oil pressure-switching mechanism is controlled by the ECU 2, whereby the supply and cut-off of the oil pressure to the third switching valve 46 is switched.

According to the configuration described above, when the third switching valve 46 is not supplied with oil pressure, the pistons 47*a*, 47*b* are engaged with the low-speed and inactive rocker arms 12*a*, 12*b* alone, respectively, by the urging force of the coil spring 49, whereby the two rocker arms 12*a*, 12*b* are disconnected from each other and in a free state (state shown in FIG. 15). Therefore, in this state, the first switching valve 17 can switch the operation of the first and second intake valves IV1, IV2 between the Lo.-inactive V/T mode and the Hi. V/T mode. On the other hand, when the supply of oil pressure to the first switching valve 17 is stopped and the third switching valve 46 is supplied with oil pressure, the piston 47*b* is engaged with the low-speed and inactive rocker arms 12*a*, 12*b* in a bridging manner, whereby the rocker arms 12*a*, 12*b* are connected with each other to operate together, so that the first and second intake valves IV1, IV2 are both opened and closed by the low-speed cam 11*a* in Lo. V/T (hereinafter referred to as "the Lo. V/T mode"). Further, in this Lo. V/T mode, by supplying the oil pressure to the second switching valve 27 to cause the EMA 29 to operate, the closing timing of the first and second intake valves IV1, IV2 can be simultaneously controlled.

As described above, in the present embodiment, the respective operation modes of the first and second intake valves IV1, IV2 can be switched between the three modes of the Lo.-inactive V/T mode, the Hi. V/T mode, and the Lo. V/T mode. Further, in the Lo.-inactive V/T mode, the closing timing of the first intake valve IV1 can be controlled, while in the Lo. V/T mode, the closing timing of the first and second intake valves LV1, LV2 can be simultaneously controlled.

Figures 16, 17:
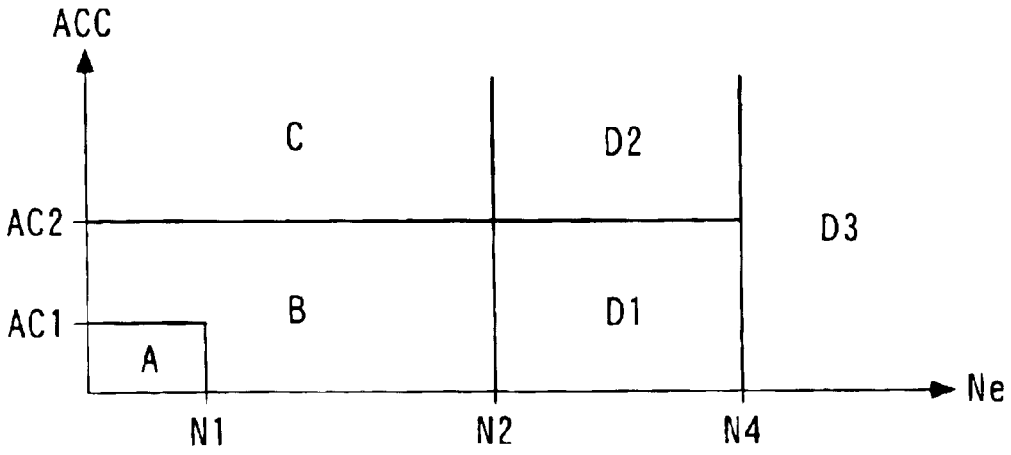
FIG. 16 shows a table showing an example of operation settings of first and second intake valves and an electromagnetic actuator in the FIG. 15 valve control apparatus.
FIG. 17 shows an example of an operating region map used for the operation settings in FIG. 16.

FIG. 16 shows a summary of examples of operation settings of the first and second intake valves IV1, IV2 and the EMA 29 for operating regions of the engine 3. FIG. 17 shows an example of a map of the operating regions. In this operating region map, the operating region D appearing in FIG. 9 is subdivided into smaller regions, and within this operating region D, a region in which the engine rotational speed Ne is lower than a fourth predetermined value N4 (e.g. 4500 rpm) and the accelerator opening ACC is lower than the second predetermined value AC2 is set to an operating region D1 (medium-rotational speed/low-load region), a region in which the Ne value is lower than the fourth predetermined value N4 and the ACC value is equal to or higher than the second predetermined value AC2 is set to an operating region D2 (medium-rotational speed/high-load region), and a region in which the Ne value is equal to higher than the fourth predetermined value N4 is set to an operating region D3.

Then, as shown in FIG. 16, in the operating region D1, the first and second intake valves IV1, IV2 are both set to Lo. V/T and the EMA 29 is made active whereby both the intake valves IV1, IV2 are controlled to late closing. Further, in the operating region D2, the intake valves IV1, IV2 are set to Lo. V/T and at the same time, the EMA 29 is made inactive, and in the operating region D3, the intake valves IV1, IV2 are set to Hi. V/T, and the EMA 29 is made inactive. The operation settings in the other operating regions are the same as those in the first embodiment.

Therefore, in the present embodiment, it is possible to obtain the same advantageous effects as provided by the first and second embodiments, and in addition, in the operating region D1, i.e. in the medium-rotational speed/low-load region, the first and second intake valves IV1, IV2 are controlled to late closing, which makes it possible to widen the region in which the pumping loss is reduced, and therefore, it is possible to further improve the fuel economy.

Figure 18:
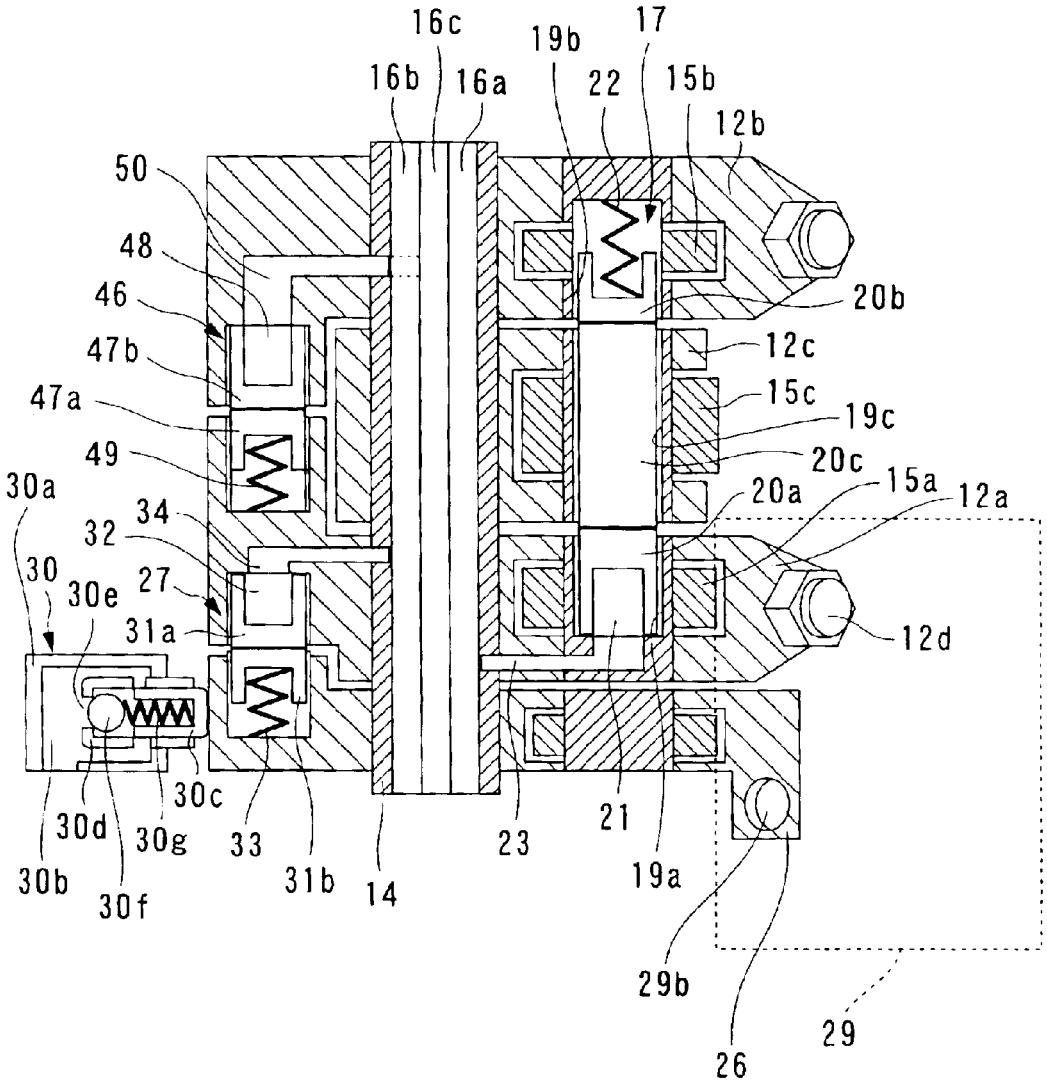
FIG. 18 is a cross-sectional view showing a variation of the valve control apparatus.

FIG. 18 shows a variation of the valve control apparatus. As is clear from comparison with FIG. 15, this variation is distinguished from the valve control apparatus of the third embodiment in that the construction of the EMA rocker arm 26 is modified. The EMA rocker arm 26 is formed to have an L shape bent away from the low-speed rocker arm 12*a*, and the abutment portion 29*b* of the EMA rocker arm 26 with which the stopper rod 40 of the EMA 29 abuts is disposed at a location closer to the rocker shaft 14 than the abutment portion 12*d* of the low-speed rocker arm 12*a* with which the first intake valve IV1 abuts. Therefore, according to this variation, it is possible to reduce the stroke of the actuator required to hold the first intake valve IV1, whereby the length of the stopper rod 4 can be reduced to reduce the size of the apparatus along the axis of the stopper rod 4, and further, since the abutment portion 29*b* is disposed closer to the rocker shaft 14, the distance from the rocker shaft 14 to the abutment portion 12*d* of the low-speed rocker arm 12*a* with which the first intake valve IV1 abuts can be reduced, which makes it possible to reduce the size of the apparatus in this direction. Thus, the valve system can be reduced in size in both the directions. Further, since the EMA rocker arm 26 is a separate member from the low-speed rocker 12*a*, even if the abutment portion 29*b* is arranged as described above, interference with the first oil pressure-switching mechanism 18 and so forth arranged in its vicinity can be avoided. Therefore, the EMA 29 can be disposed in compact arrangement in the direction of operation of the stopper rod 40.

Figure 19:
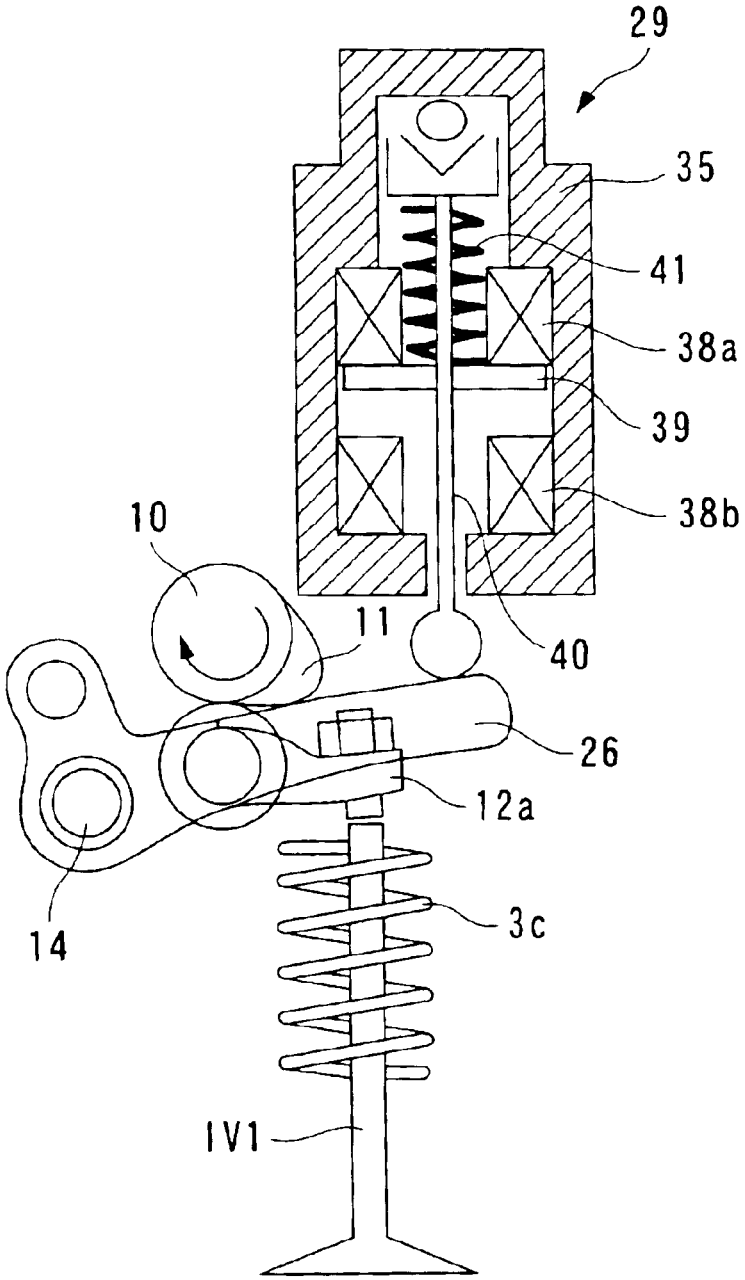
FIG. 19 is a cross-sectional view of a valve control apparatus for an internal combustion engine, according to a fourth embodiment of the invention.
Figure 20:
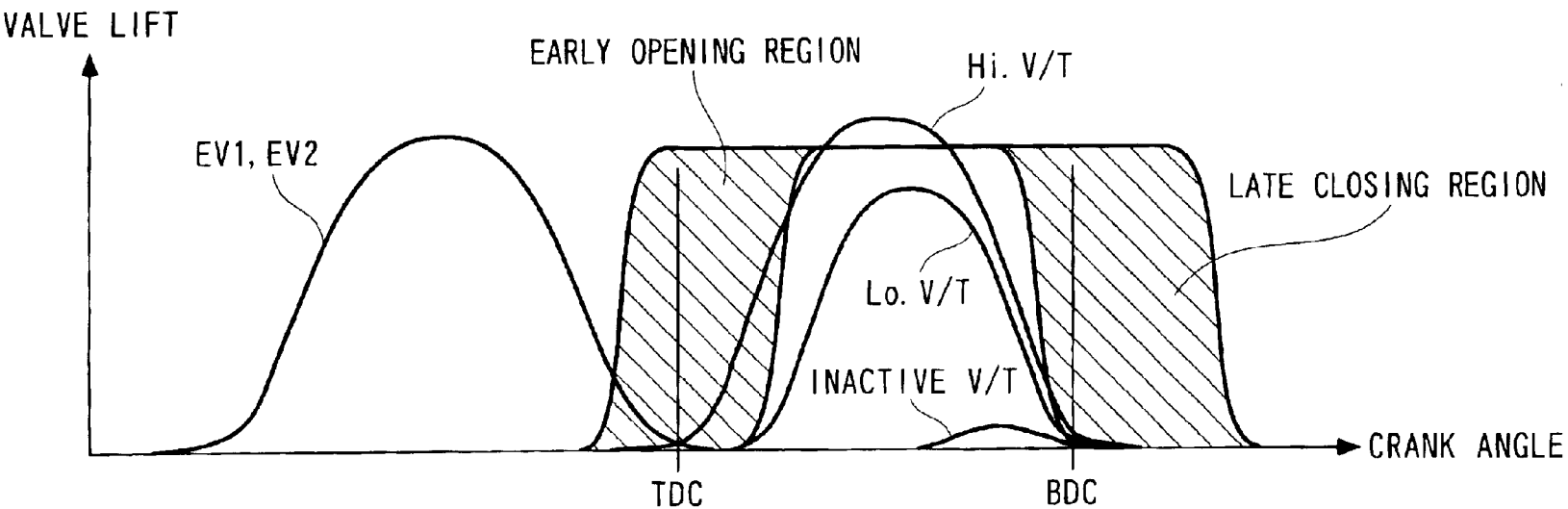
FIG. 20 is a diagram showing an example of operations of intake and exhaust valves performed with the FIG. 19 valve control apparatus.

FIG. 19 shows a valve control apparatus according to a fourth embodiment of the invention. This embodiment is distinguished from the first to third embodiment in the construction of the EMA 29. This EMA 29 includes a pair of upper and lower electromagnets 38*a*, 38*b*, and an armature 39 integrally formed with the stopper rod 40 is disposed between these electromagnets 38*a*, 38*b*. The stopper rod 40 is urged downward by the follow-up coil spring 41, and at the same time, connected to the EMA rocker arm 26 to operate together. Further, as shown in FIG. 20, the stroke of the EMA 29 is configured such that it is larger than the maximum lift of the first intake valve IV1 in Lo. V/T, and at the same time, smaller than the maximum lift of the same in Hi. V/T.

Therefore, according to this construction, in the active mode of the EMA 29 in which the EMA rocker arm 26 is connected to the low-speed rocker arm 12*a*, by controlling the timing of energization of the upper and lower electromagnets 38, it is possible to control the opening and closing timing of the first intake valve IV1. More specifically, as indicated by a hatched area in FIG. 20, it is possible not only to control the first intake valve IV1 to late closing similarly to the first to third embodiments but also to control the same to early opening. Further, since the stroke of the EMA 29 is larger than the maximum lift of the first intake valve IV1 in Lo. V/T, it is possible to carry out early opening of the first intake valve IV1 in Lo. V/T, and continue the state, whereby even the preferential application of the valve timing by the EMA 29 to Lo. V/T is also possible. It should be noted that in the inactive mode of the EMA 29 in which the EMA rocker arm 26 is disconnected from the low-speed rocker arm 12*a*, similarly to the embodiments described above, the low-speed rocker arm 12*a* is pivoted in a state completely free from them the EMA rocker arm 26 and the EMA 29 without being adversely affected by the intertial mass thereof.

Figures 21, 22:
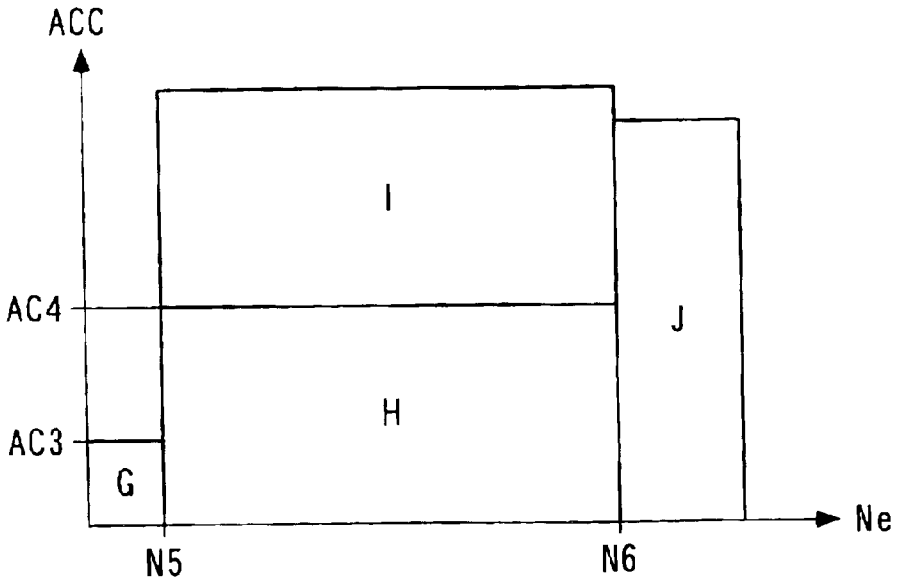
FIG. 21 shows a table showing an example of operation settings of first and second intake valves and an electromagnetic actuator in the FIG. 19 valve control apparatus.
FIG. 22 shows an example of an operating region map used for the operation settings in FIG. 21.

FIG. 21 shows an example of operation settings of the first and second intake valves IV1, IV2 and the EMA 29 in the present embodiment for operating regions of the engine 3. FIG. 22 shows an example of a map of these operating regions. As shown in these figures, in this example, in an operating region G (low-rotational speed/low-load region) in which the engine rotational speed Ne is lower than a fifth predetermined value N5 (e.g. 800 rpm) and at the same time the accelerator opening ACC is lower than a third predetermined value AC3 (e.g. 10%), the first intake valve IV1 and the second intake valve IV2 are set to Lo. V/T and inactive V/T, respectively, and the EMA 29 is made inactive. Further, an operating region H (medium-rotational speed/low-load region) in which the Ne value is equal to or higher than the fifth predetermined value N5 and lower than a sixth predetermined value N6 (e.g. 3500 rpm) and the ACC value is lower than a fourth predetermined value AC4 (e.g. 80%), the first and second intake valve IV1, IV2 are set to Lo. V/T and inactive V/T, respectively, and the EMA 29 is made active and controlled for the early opening and late closing. This makes it possible to introduce internal EGR in the medium-rotational speed/low-load region, to thereby reduce exhaust emissions.

Further, in an operating region I (medium-rotational speed/high-load region) in which the Ne value is equal to or higher than the fifth predetermined value N5 and lower than the sixth predetermined value N6 and the ACC value is equal to or higher than the fourth predetermined value AC4, the first and second intake valves IV1, IV2 are set to Lo.VT and inactive V/T, respectively, and the EMA 29 is made active and controlled for the early opening. This makes it possible to increase the power output in the medium-rotational speed/high-load region. Further, in an operating region J (high-rotational speed region) in which the Ne value is equal to or higher than the sixth predetermined value N6, the first and second intake valves IV1 and IV2 are both set to Hi. V/T, and the EMA 29 is made inactive. It should be noted that the above configurations are described only by way of example, and configurations of operating regions, the valve timing of the first and second intake valves IV1, IV2, and the active and inactive states of the EMA 29, as well as a combination of these configurations can be changed as required.

It should be noted that the present invention is not limited to the embodiments described above, but can be embodied in various forms. For example, although in the embodiments, description is given of cases in which the invention is applied to the intake valves as the engine valves, this is not limitative, but the invention may be applied to exhaust valves and the valve-closing timing thereof may be controlled. This enables the overlap amount to be variably controlled, thereby enhancing the power output and reducing exhaust emissions. Further, although in the present embodiment, as the actuator for holding the intake valve in the open state, the electromagnetic actuator is employed, this is not limitative, but the invention can be applied to other types of actuators, such as a hydraulic type and an air-driven type.

Further, although in the embodiments, as one of the parameters for defining an operating region of the engine 3 for determining the operation mode of the EMA 29 etc., the accelerator opening ACC is employed, this is not limitative, but in place of this, the intake pipe absolute pressure, throttle valve opening, cylinder internal pressure, intake air amount, or other like parameters representative of load on the engine 3, may be used. Further, although in the present embodiment, the switching mechanism for forcibly switching the EMA 29 to the inactive mode is formed by a hydraulic type, this is not limitative, but an electric or other type may be employed.

Moreover, although in the above embodiments, the cam-type valve actuating mechanism is employed in combination with the VTEC 13, this is not limitative, but the present invention can be applied to a cam-type valve actuating mechanism which is used in combination a cam phase variable mechanism for continuously varying the cam phase, together with VTEC 13 or in place therewith.

INDUSTRIAL APPLICABILITY

As described heretofore, the valve control apparatus for an internal combustion engine, according to the invention, actuates an engine valve by the cam-type actuating mechanism, and at the same time, depending on operating conditions of the engine, the actuator is made active as required, whereby the closing timing of the engine valve can be controlled as desired and optimally set. Further, when the actuator is inactive, the actuator is disconnected from the cam-type valve actuating mechanism, whereby the engine valve can be opened and closed without increasing the inertial mass of the engine valve. Therefore, the valve control apparatus according to the invention can be suitably used in an internal combustion engine which needs attaining the improvement of fuel economy and realization of higher rotational speed and higher power output in a compatible fashion, and reducing cost and weight thereof.

What is claimed is:

1. A valve control apparatus for an internal combustion engine for controlling opening and closing operations of an engine valve, the valve control apparatus comprising:

a cam-type valve actuating mechanism that actuates said engine valve to open and close said engine valve, by a cam which is driven in synchronism with rotation of said engine;

an actuator that makes blocking engagement with said engine valve having been opened, to thereby hold said engine valve in an open state;

a rocker shaft;

an actuating rocker arm pivotally supported on said rocker shaft, for being brought into abutment with said engine valve and being driven by said cam to actuate said engine valve to open and close said engine valve;

a holding rocker arm pivotally supported on said rocker shaft, for having said actuator brought into abutment therewith, to hold said engine valve in the open state;

operating condition-detecting means for detecting operating conditions of said engine;

a switching mechanism for switching an operation mode of said actuator between an active mode in which said actuator makes the blocking engagement with said engine valve and an inactive mode in which said actuator does not make the blocking engagement with said engine valve, wherein said switching mechanism switches the operation mode of said actuator between the active mode and the inactive mode, by switching a state of said actuating rocker arm and said holding rocker arm between a connected state in which said actuating rocker arm and said holding rocker arm are connected to each other, and a disconnected state in which said actuating rocker arm and said holding rocker arm are disconnected from each other;

operation mode-determining means for determining the operation mode of said actuator according to the detected operating conditions of said engine; and control means for controlling operation of said actuator to thereby control closing timing of said engine valve;

wherein said control means controls operation of said actuator according to the detected operating conditions of said engine and controls operation of said switching mechanism according to the determined operation mode.

2. A valve control apparatus according to claim 1, wherein said actuating rocker arm comprises a plurality of actuating rocker arms, wherein the valve control apparatus further comprises a first hydraulic switching mechanism for hydraulically switching a state of said plurality of actuating rocker arms between a connected state in which said plurality of actuating rocker arms are connected to each other and a disconnected state in which said plurality of actuating rocker arms are disconnected from each other, wherein said switching mechanism is formed by a second hydraulic switching mechanism, wherein one of said plurality of actuating rocker arms is formed with an oil chamber for said first hydraulic switching mechanism, and wherein said holding rocker arm is arranged adjacent to said actuating rocker arm formed with said oil chamber.

3. A valve control apparatus according to claim 1, wherein an abutment portion of said holding rocker arm with which said actuator abuts is disposed at a location remoter from said rocker shaft than an abutment portion of said actuating rocker arm with which said engine valve abuts is.

4. A valve control apparatus according to claim 1, wherein an abutment portion of said holding rocker arm with which said actuator abuts is disposed at a location closer to said rocker shaft than an abutment portion of said actuating rocker arm with which said engine valve abuts is.

5. A valve control apparatus according to claim 1, wherein said switching mechanism switches a state of said actuating rocker arm and said holding rocker arm to a connected state when said engine is in a low rotational speed condition, and to a disconnected state when said engine is in a high rotational speed condition.

6. A valve control apparatus for an internal combustions engine for controlling opening and closing operations of an engine valve, the valve control apparatus comprising:

a rocker shaft;

an actuating rocker arm pivotally supported on said rocker shaft, for being brought into abutment with said engine valve and being driven by a cam which is driven in synchronism with rotation of said engine, to thereby actuate said engine valve to open and close said engine valve;

an actuator that makes blocking engagement with said engine valve having been opened, to thereby hold said engine valve in an open state;

a holding rocker arm pivotally supported on said rocker shaft, for having said actuator brought into abutment therewith, to hold said engine valve in the open state;

a switching mechanism for switching an operation mode of said actuator between an active mode in which said actuator between an active mode in which said actuator makes the blocking engagement with said engine valve and an inactive mode in which said valve actuator does not make the blocking engagement with said engine valve, by switching a state of said actuating rocker arm and said holding rocker arm between a connected state in which said actuating rocker arm and said holding rocker arm are connected to each other, and a disconnected state in which said actuating rocker arm and said holding rocker arm are disconnected from each and other; and control means for controlling operation of said actuator to thereby control closing timing of said engine valve.

7. A valve control apparatus according to claim 6, further comprising operating condition-detecting means for detecting operating conditions of said engine, and operation mode-determining means for determining the operation mode of said actuator according to the detected operating conditions of said engine, and wherein said control means controls operation of said switching mechanism according to the determined operation mode.

8. A valve control apparatus according to claim 6, wherein said switching mechanism is formed by a hydraulic switching mechanism for hydraulically switching the operation mode of said actuator, and wherein said control means causes said actuator to be made inactive when said engine is started.

9. A valve control apparatus according to claim 6, wherein said actuator is formed by an electromagnetic actuator comprising;

a single electromagnet that has a coil whose energization is controlled by said control means, an armature that is attracted to said electromagnet when said coil is energized, and a stopper provided integrally with said armature, for being brought into blocking engagement with said engine vale having been opened, in a state in which said armature has been attracted to said electromagnet.

10. A valve control apparatus according to claim 6, further comprising a hydraulic impact-lessening mechanism that lessens an impact on said engine valve caused by operation of said actuator.

11. A valve control apparatus according to claim 6, wherein said actuating rocker arm comprises a plurality of actuating rocker arms, wherein the valve control apparatus further comprises a first hydraulic switching mechanism for hydraulically switching a state of said plurality of actuating rocker arms between a connected state in which said plurality of actuating rocker arms are connected to each other and a disconnected state in which said plurality of actuating rocker arms are disconnected from each other, wherein said switching mechanism is formed by a second hydraulic switching mechanism, wherein one of said plurality of actuating rocker arms is formed with an oil chamber for said first hydraulic switching mechanism, and wherein said holding rocker arm is arranged adjacent to said actuating rocker arm formed with said oil chamber.

12. A valve control apparatus according to claim 6, wherein an abutment portion of said holding rocker arm with which said actuator abuts is disposed at a location remoter from said rocker shaft than an abutment portion of said actuating rocker arm with which said engine valve abuts.

13. A valve control apparatus according to claim 6, wherein an abutment portion of said holding rocker arm with which said actuator abuts is disposed at a location closer to said rocker shaft than an abutment portion of said actuating rocker arm with which said engine valve abuts.

14. A valve control apparatus according to claim 6, wherein said switching mechanism switches a state of said actuating rocker arm and said holding rocker arm to a connected state when said engine is in a low rotational speed condition, and to a disconnected state when said engine is in a high rotational speed condition.

* * * * *